US007258082B2

(12) United States Patent
Huettlin

(10) Patent No.: US 7,258,082 B2
(45) Date of Patent: Aug. 21, 2007

(54) OSCILLATING-PISTON MACHINE

(76) Inventor: Herbert Huettlin, Ruemminger Strasse 15, 79539 Loerrach (DE)

( * ) Notice: Subject to any disclaimer, the term of this patent is extended or adjusted under 35 U.S.C. 154(b) by 115 days.

(21) Appl. No.: 11/258,989

(22) Filed: Oct. 26, 2005

(65) Prior Publication Data

US 2006/0191499 A1 Aug. 31, 2006

(30) Foreign Application Priority Data

Feb. 25, 2005 (DE) ..... 10 2005 010 775

(51) Int. Cl.
*F01C 1/02* (2006.01)

(52) U.S. Cl. ..... 123/18 R; 418/68; 418/35; 418/36; 418/37; 418/38; 123/241; 123/245

(58) Field of Classification Search ..... 418/35–38, 418/68, 405, 481; 123/241, 245, 18 R
See application file for complete search history.

(56) References Cited

U.S. PATENT DOCUMENTS

| | | | | |
|---|---|---|---|---|
| 1,880,131 | A * | 9/1932 | Gray | 418/68 |
| 2,043,544 | A * | 6/1936 | Kempthorne | 417/405 |
| 3,040,664 | A | 6/1962 | Hartley | 103/4 |
| 3,075,506 | A | 1/1963 | Berry | 123/43 |
| 3,556,696 | A | 1/1971 | Bertoni | 418/68 |
| 4,021,158 | A | 5/1977 | Bajulaz | 418/52 |
| 4,441,869 | A | 4/1984 | Larsen et al. | 418/51 |
| 4,487,168 | A | 12/1984 | Bajulaz | 123/18 |
| 5,404,849 | A | 4/1995 | Fenton | 123/241 |
| 6,241,493 | B1 | 6/2001 | Turner | 418/1 |
| 6,289,867 | B1 | 9/2001 | Free | 123/245 |
| 6,325,038 | B1 | 12/2001 | Millett | 123/241 |
| 6,457,451 | B1 | 10/2002 | Sakita | 123/245 |
| 2005/0008515 | A1* | 1/2005 | Huttlin | 417/481 |

FOREIGN PATENT DOCUMENTS

| | | |
|---|---|---|
| CA | 2 308 709 | 5/1999 |
| DE | 812 949 C1 | 7/1951 |
| DE | 19 03 381 A1 | 9/1969 |
| DE | 21 61 572 A | 6/1973 |
| DE | 25 19 911 A1 | 2/1976 |

(Continued)

OTHER PUBLICATIONS

International Search Report; May 17, 2006; 11 pages.

*Primary Examiner*—Thomas Denion
*Assistant Examiner*—Mary A. Davis
(74) *Attorney, Agent, or Firm*—St. Onge Steward Johnston & Reens LLC

(57) ABSTRACT

An oscillating-piston machine comprises a housing, in which a first and at least a second piston are arranged, which pistons can together revolve in the housing about an axis of rotation that is fixed with respect to the housing, and which pistons, as they revolve about the axis of rotation, execute oppositely directed reciprocating pivoting movements about a pivot axis running perpendicular to the axis of rotation and through the centre of the housing, the first piston having a first end face, and the at least second piston having a second end face facing the first end face, the end faces delimiting a working chamber, characterized in that the pistons are arranged in such a way that the axis of rotation runs through the working chamber.

18 Claims, 18 Drawing Sheets

FOREIGN PATENT DOCUMENTS

| | | | |
|---|---|---|---|
| DE | 23 51 990 | B2 | 5/1977 |
| DE | 28 08 769 | A1 | 9/1979 |
| DE | 34 08 560 | A1 | 9/1984 |
| DE | 42 42 449 | A1 | 6/1994 |
| DE | 195 22 094 | A | 1/1997 |
| DE | 197 47 445 | | 5/1999 |
| DE | 297 24 399 | U1 | 8/2001 |
| FR | 798 793 | A | 5/1936 |
| FR | 2 322 282 | | 3/1977 |
| GB | 1 259 801 | | 1/1972 |
| GB | 2 262 965 | A | 7/1993 |
| WO | WO98/13583 | | 4/1998 |
| WO | WO 03/067033 | A1 | 8/2003 |

* cited by examiner

OSCILLATING-PISTON MACHINE

CROSS-REFERENCE TO RELATED APPLICATION

The present application claims priority of German patent application No. 10 2005 010 775.3 filed on Feb. 25, 2005.

BACKGROUND OF THE INVENTION

The invention generally relates to oscillating-piston machines.

Oscillating-piston machines, and in particular an oscillating-piston machine in accordance with the present invention, can be used as internal combustion engines, as pumps or as compressors. An oscillating-piston machine in accordance with the present invention is preferably used as an internal combustion engine and is described in this form in the present description.

If an oscillating-piston machine is used as an internal combustion engine, the individual working strokes of intake, compression, ignition of the combustion mix and expansion and exhaust of the burnt combustion mix are produced by reciprocating pivoting movements of the individual pistons between two limit positions.

In the case of the oscillating-piston machine which is known from document WO 03/067033 A1, in the name of the same Applicant, four pistons are arranged in the housing, and these pistons revolve jointly about an axis of rotation which is arranged fixedly in the centre of the housing, and as they revolve they execute reciprocating pivoting movements about a pivot axis in the housing, with in each case two adjacent pistons pivoting in opposite directions. In this known oscillating-piston machine, in each case two pistons arranged diametrically opposite one another with respect to the centre of the housing are rigidly connected to one another to form a double piston, and two piston pairs of this type are in a crossed-over arrangement in the centre of the housing. In each case one working chamber is formed between in each case two end faces of the piston of the piston pairs facing one another, so that the known oscillating-piston machine has two working chambers. The size of the two working chambers which are arranged diametrically opposite with respect to the centre of the housing increases and decreases in the same direction with the reciprocating pivoting movement of the pistons.

The pistons of this known oscillating-piston machine are arranged in such a way in the housing that in their TDC position, in which the volumes of the two working chambers are at a minimum, they are positioned perpendicular to the axis of rotation. In this position, the centrifugal forces acting on the pistons during the revolution of the pistons about the axis of rotation are at a maximum. The result of this is that at high rotational speeds the expansion or movement of the pistons away from one another has to take place counter to the centrifugal forces, since the centrifugal forces counteract this movement of the pistons away from one another. In this oscillating-piston machine, the working chambers are always located outside and perpendicular to the axis of rotation.

The pistons of the known oscillating-piston machine are substantially in the form of a wedge of a sphere, and correspondingly so is the geometry of the working chambers.

Although the known oscillating-piston machine has very good operating properties, it is an object of the present invention to provide a new design of an oscillating-piston machine which differs from the design of the known oscillating-piston machine described above.

SUMMARY OF THE INVENTION

Therefore, the invention is based on the object of providing a new design of this type for an oscillating-piston machine of the type described in the introduction.

According to the invention, an oscillating-piston machine is provided, comprising a housing defining a centre, a first piston and at least a second piston, the first piston and the at least second piston being arranged in the housing and being able to revolve together in the housing about an axis of rotation which is stationary with respect to the housing, the first piston and the at least second piston executing oppositely directed reciprocating pivoting movements about a pivot axis, as the first and the at least second piston revolve about the axis of rotation, the pivot axis running perpendicular through said axis of rotation and through the centre of the housing, the first piston having a first end face, and the at least second piston having a second end face facing the first end face, the first end face and the second end face delimiting a first working chamber, and the first piston and the at least second piston being arranged in such a way that the axis of rotation runs through the first working chamber.

The novel design of the oscillating-piston machine according to the invention compared to the known oscillating-piston machine accordingly consists in the at least two pistons being arranged in such a way that the at least one working chamber is not located perpendicular to the axis of rotation, but rather on the axis of rotation or around the axis of rotation. The centrifugal forces which act on the two pistons delimiting the working chamber as they revolve about the axis of rotation are lower on account of the reduced distance between the pistons and the axis of rotation, and moreover they act in the direction in which the two pistons are moved away from one another, i.e. the centrifugal forces assist the working stroke of expansion. The centrifugal forces which occur perpendicular to the axis of rotation during revolution of the pistons about the axis of rotation therefore assist with the expansion of the at least one working chamber.

In a preferred configuration, it is provided that the first and second end faces of the first and at least second pistons are circular in form.

In this configuration, the first and at least second pistons are cylindrical at least in the region which adjoins their end faces, and are therefore very similar to conventional pistons of linear reciprocating-piston engines in this region. One advantage which results from this is that piston rings, if appropriate with a corresponding curvature, can be used as seals for the two pistons, so that in this respect it is possible to make use of long-standing experience in solving sealing problems in linear reciprocating-piston engines. In this configuration, the working chamber delimited by the two end faces of the first and at least second piston has the geometry of a cylinder or toroid section curved about the oscillation axis.

However, as an alternative to a circular configuration of the end faces of the first and at least second pistons, it is also possible to select a different geometry, for example an oval shape, which contributes to increasing the size of the at least one working chamber in particular if the interior of the housing is spherical-symmetrical.

In a further preferred configuration, the first and the at least second pistons are designed substantially in the form of an arc.

It will be understood that the arcuate configuration of the first and at least second pistons may be restricted to the region adjoining their end faces, i.e., as will be described in more detail below, outer sides of the pistons which are remote from the end faces may be used as functional elements for controlling the pistons in order to derive the pivoting movement from the revolving movement of the pistons, and for this purpose may be configured in different ways.

In a further preferred configuration, the first piston and/or the at least second piston has at least one running member which, when the first and/or at least second piston is revolving, is guided along a corresponding designed control cam, in order to generate the pivoting movements of the first and at least second piston, the control cam being arranged on the housing, at at least approximately a maximum distance from the axis of rotation.

In the known oscillating-piston machine, there is a comparable control mechanism for controlling the pivoting movements of the pistons, but in that case the control cam is at a shorter distance from the axis of rotation, in the vicinity of the end sides of the housing. The advantage of the greater distance between the control cam and the axis of rotation consists in improved lever ratios, in order to derive the pivoting movements of the at least two pistons from their revolving movement about the axis of rotation.

In this context, it is also preferable if the at least one running member is a ball which is mounted rotatably in a ball socket on an outer side, facing the housing, of the first and/or at least second piston, and if the control cam is designed as a groove with a cross section in the form of part of a circle in the housing, in which groove the ball partially engages.

A control mechanism of this type, which uses a ball as the at least one running member, has the advantage of optimum reduction in friction in the control mechanism, since the ball can rotate freely in the ball socket of the at least one piston, and also in the groove in the housing, so that the ball can follow the control cam with particularly little friction, on account of the fact that it can rotate in all directions.

The ball socket may be designed in such a way that it holds the ball captively, or the ball can be held in the ball socket by adhesion forces by means of a lubricating film which is provided by oil lubrication.

It is preferable for both the first and the at least second piston to have a running member in the form of a ball, which balls can run at a distance from one another in the same groove-like control cam in the housing.

In a further preferred configuration, the first and the at least second piston are mounted slideably in a piston cage, which is arranged in the housing, concentrically with respect to and rotatable about the axis of rotation, the piston cage being rotationally fixedly connected to the first and at least second piston with respect to the revolving movement about the axis of rotation.

The ball cage and the first and at least second piston therefore form the "inner machine" or "inner motor" of the oscillating-piston machine. The sliding mounting of the two pistons in the piston cage is used for the pivoting mobility of the two pistons about the pivot axis, while on account of being rotationally fixedly connected to the piston cage in terms of the revolving movement about the axis of rotation, the pistons revolve with the piston cage about the axis of rotation. The piston cage can now advantageously be used as a drive or output member and may accordingly be designed as a shaft extension protruding out of the housing.

In a further preferred configuration, the piston cage, approximately perpendicular to the axis of rotation, has a bore in which the first and at least second piston are partially received, such that they slide therein, and which delimits the working chamber in the circumferential direction.

The bore therefore defines, together with the two end faces, which face one another, of the first and at least second piston, the at least one working chamber of the oscillating-piston machine. The geometry of the bore in the piston cage is also selected according to the geometry of the end faces of the two pistons, i.e. for example to be circular or, as has already been mentioned above, oval or some other shape corresponding to the shape of the end faces of the pistons. If the end faces of the two pistons are circular in form, the result, in combination with the circular bore in the piston cage, is a working chamber which corresponds to a curved cylinder or a toroid section. The pistons are then preferably sealed against the wall of the bore of the piston cage by means of seals, the latter, in the case of a circular bore and circular end faces, advantageously being designed as piston rings matched to the shape of the working chamber.

In a further preferred configuration, a passage passes through the piston cage and on one side opens out in the bore, while on the other side it opens out toward the housing, in order to be in communication with an inlet opening or an outlet opening in the housing, depending on the rotational position of the piston cage.

The advantage of this measure is that the piston cage, by means of the abovementioned passage or opening, acts as a type of valve for the inlet and outlet openings in the housing. It is therefore not necessary for the inlet and outlet openings in the housing to be provided with separate valves, or to provide a complex control of the valve for the instant of opening or closing, as is the case in conventional linear reciprocating-piston engines. The opening and closing of the inlet and outlet openings to admit combustion air and/or fuel and to discharge burnt combustion mix take place automatically at the correct stroke as a result of the revolving movement of the piston cage about the axis of rotation.

In a further preferred configuration, the piston cage has at least one passage for a medium, in particular coolant/lubricant, which extends at least partially over the circumference and through the interior of the piston cage.

One advantage of this arrangement is that the piston cage advantageously performs a further function, namely that of supplying all the moving parts within the housing with a cooling and/or lubricating medium. A cooling/lubricating medium can be supplied via connections arranged at the housing, in which case the at least one passage preferably extends as an annular passage on the outer side of the piston cage, so that the at least one passage is always in communication with the supply connections.

In a further preferred configuration, a bore, which preferably widens out at its ends, passes through the piston cage at the level of and in the direction of the pivot axis.

This bore advantageously serves as a further coolant/lubricant passage, which makes a contribution to particularly intensive circulation of a cooling/lubricating medium of this type, since this bore extends perpendicular to the axis of rotation, and therefore the cooling/lubricating medium which is then located therein is subjected to centrifugal forces as the piston cage revolves about the axis of rotation, causing the cooling/lubricating medium to move towards the widening ends of the bore. As a result, a ventilation effect advantageously occurs during the circulation of the cooling/lubricating medium.

In a further preferred configuration, a third and a fourth piston are arranged in the housing, which third and fourth pistons are arranged diametrically with respect to the first and second pistons, based on the pivot axis, and can pivote about this axis, can revolve about the axis of rotation with the first and second pistons and define a second working chamber.

In this configuration, a system which is advantageously symmetrical, and therefore balanced in terms of mass, with respect to the axis of rotation and pivot axis is also created in the oscillating-piston machine according to the invention.

In this context, it is preferable if the four pistons are arranged in such a way that the first and second working chambers, as the pistons revolve about the axis of rotation, increase and decrease in size in the same directions.

This configuration makes a contribution to the four pistons forming a mass-balanced system in every position of revolution and pivoting. The four pistons are preferably in each case arranged in diametrically opposite pairs with respect to the pivot axis, but unlike in the known oscillating-piston machine it is preferably provided that the four pistons be arranged individually in the housing, i.e. are not rigidly connected to one another in pairs to form double pistons.

In a further preferred configuration, the piston cage extends on both sides of the oscillation axis and also accommodates the third and fourth pistons.

Overall, therefore, this creates a particularly simple structure, requiring only a small number of parts, in which the piston cage accommodates all four pistons. For the third and fourth piston, the piston cage, if this is provided for the first and second pistons as described above, likewise has a bore for the third and fourth pistons, in which bore the third and fourth pistons are mounted slideably and are rotationally fixedly connected to the piston cage with respect to the axis of rotation, this bore, together with the end faces of the third and fourth pistons, then delimiting the second working chamber.

In a further preferred configuration, a housing inner wall of the housing is substantially spherical in form.

This configuration advantageously creates a spherical-symmetrical oscillating-piston machine, which has already proven its worth in the known oscillating-piston machine.

As an alternative, however, it can also be provided that a housing inner wall of the housing, when seen in section along a plane which includes the axis of rotation and the pivot axis, is oblong in the direction of the axis of rotation.

In this context, the term "oblong" is to be understood as meaning that the housing of the oscillating-piston machine comprises two halves of a sphere, between which is inserted a portion which is elongate in the direction of the axis of rotation. The oblong shape of the housing inner wall of the housing advantageously opens up the possibility of providing the following preferred configurations.

For example, it is preferable if a hollow pin, which can rotate about the pivot axis, is arranged in the housing, and in the wall of the hollow pin there is an opening which is in communication with the first working chamber or if appropriate with the second working chamber as a function of the rotary position of the hollow pin.

This hollow pin can advantageously be used to feed fresh air, in particular pressurized fresh air, into the working chamber or, if two working chambers are provided, into the two working chambers alternately, via the circumferentially delimited opening provided in the hollow pin. As a result, combustion air can be passed into the working chambers at an admission pressure, making it possible to achieve greater compression of the fuel-air mix in the working chambers. In this way, the oscillating-piston machine is suitable in particular as a diesel engine.

In this context, it is preferable if the hollow pin is connected to a transmission mechanism which, when the pistons revolve about the axis of rotation, makes the hollow pin rotate about the pivot axis.

In this way, the rotational movement of the hollow pin to enable its opening to communicate with one working chamber or the other can be derived, in an advantageously simple way, directly from the revolving movement of the pistons about the axis of rotation, without the need for an external control mechanism. If the step-up ratio of the transmission mechanism is selected appropriately, the rotational speed of the hollow pin is synchronized in a simple way with the rotational speed of the oscillating-piston machine.

In this context, it is also preferable if the transmission mechanism includes worm toothing gear, which is connected to the hollow pin and meshes with at least one set of toothing which is arranged at the housing and extends around the axis of rotation.

A transmission mechanism of this type is of particularly simple design, can be accommodated in the housing without an increased need for space, and given a suitable configuration of the worm toothing the rotational speed of the hollow pin can then be adapted as a function of the rotational speed of the revolving movement of the pistons about the axis of rotation.

Further advantages and features will emerge from the following description and the appended drawing.

It will be understood that the features which have been listed above and are yet to be explained below can be used not only in the combination given in each instance, but also in other combinations or as stand-alone measures without departing from the scope of the present invention.

BRIEF DESCRIPTION OF THE DRAWINGS

Exemplary embodiments of the invention are illustrated in the drawing and are described in more detail below with reference to the drawing, in which.

DETAILED DESCRIPTION OF PREFERRED EMBODIMENTS

Figure 11:
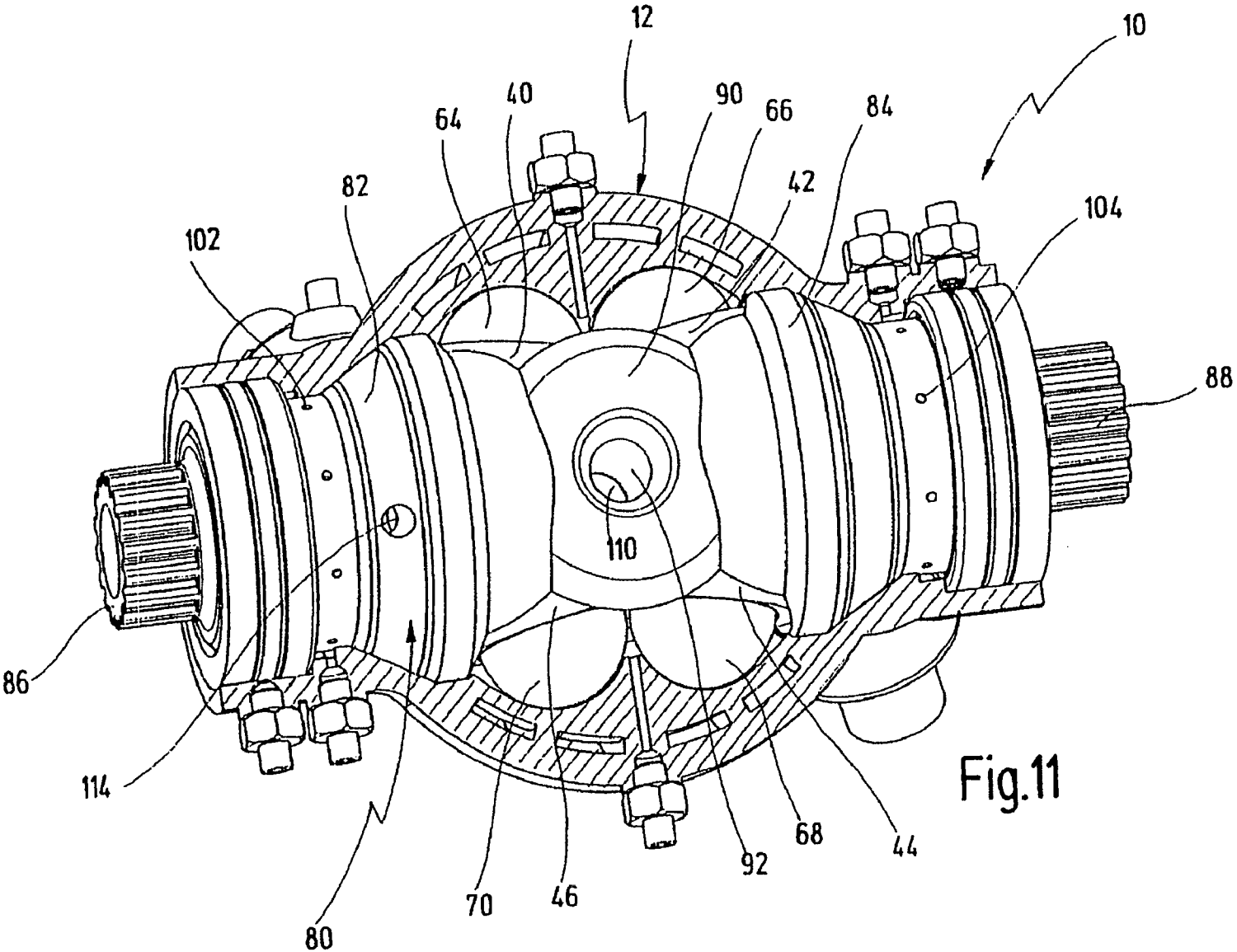
FIG. 11 shows a longitudinal section through the oscillating-piston machine similar to that shown in FIG. 3 or 4, but without the piston cage and the pistons being illustrated in section.
Figure 12:
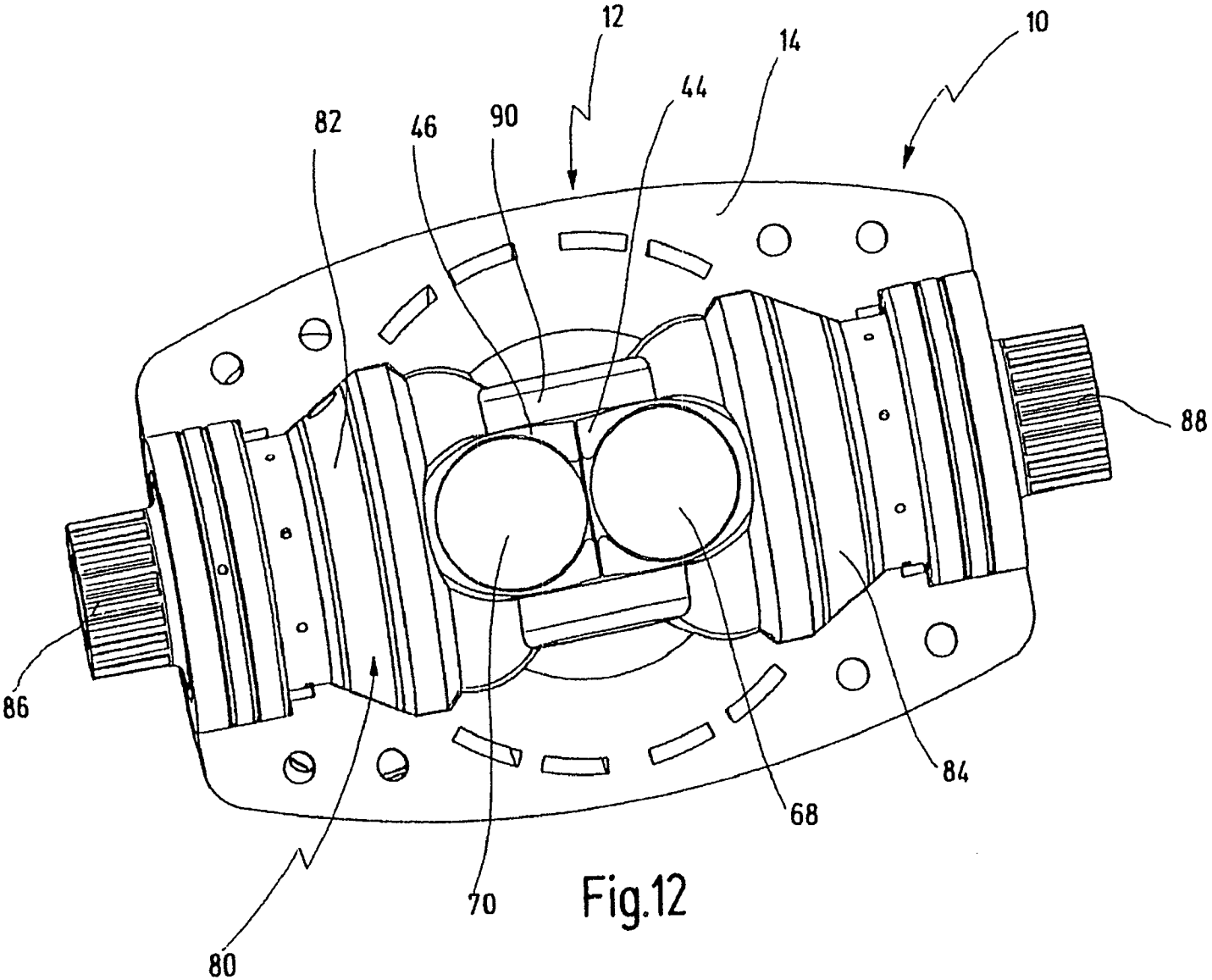
FIG. 12 shows a view of the oscillating-piston machine with one half of the housing removed.
Figure 13:
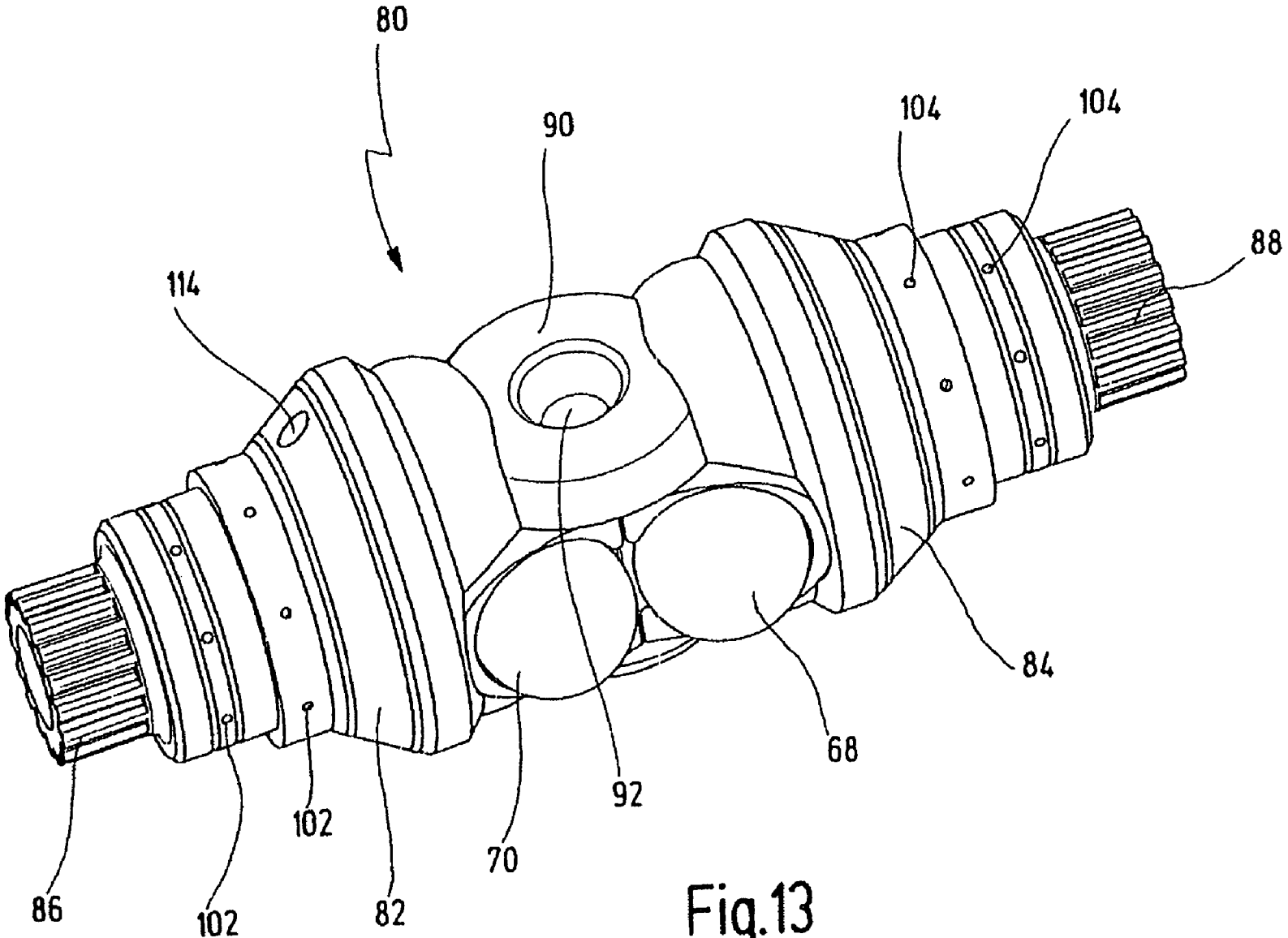
FIG. 13 shows a perspective illustration of the arrangement of piston cage and pistons alone, in perspective.
Figure 14:
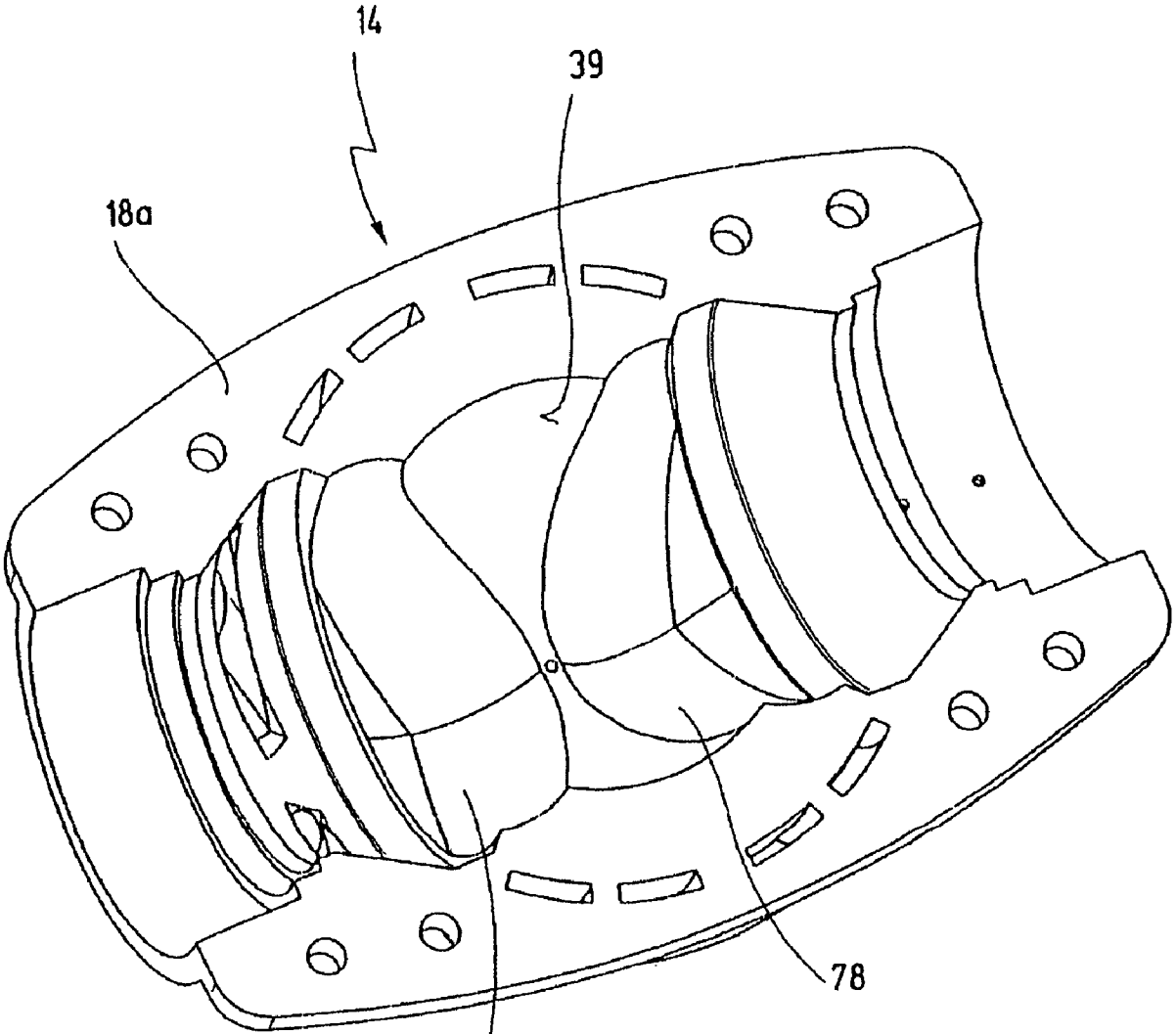
FIG. 14 shows a perspective view of an inner side of a housing half of the oscillating-piston machine alone.
Figure 15:
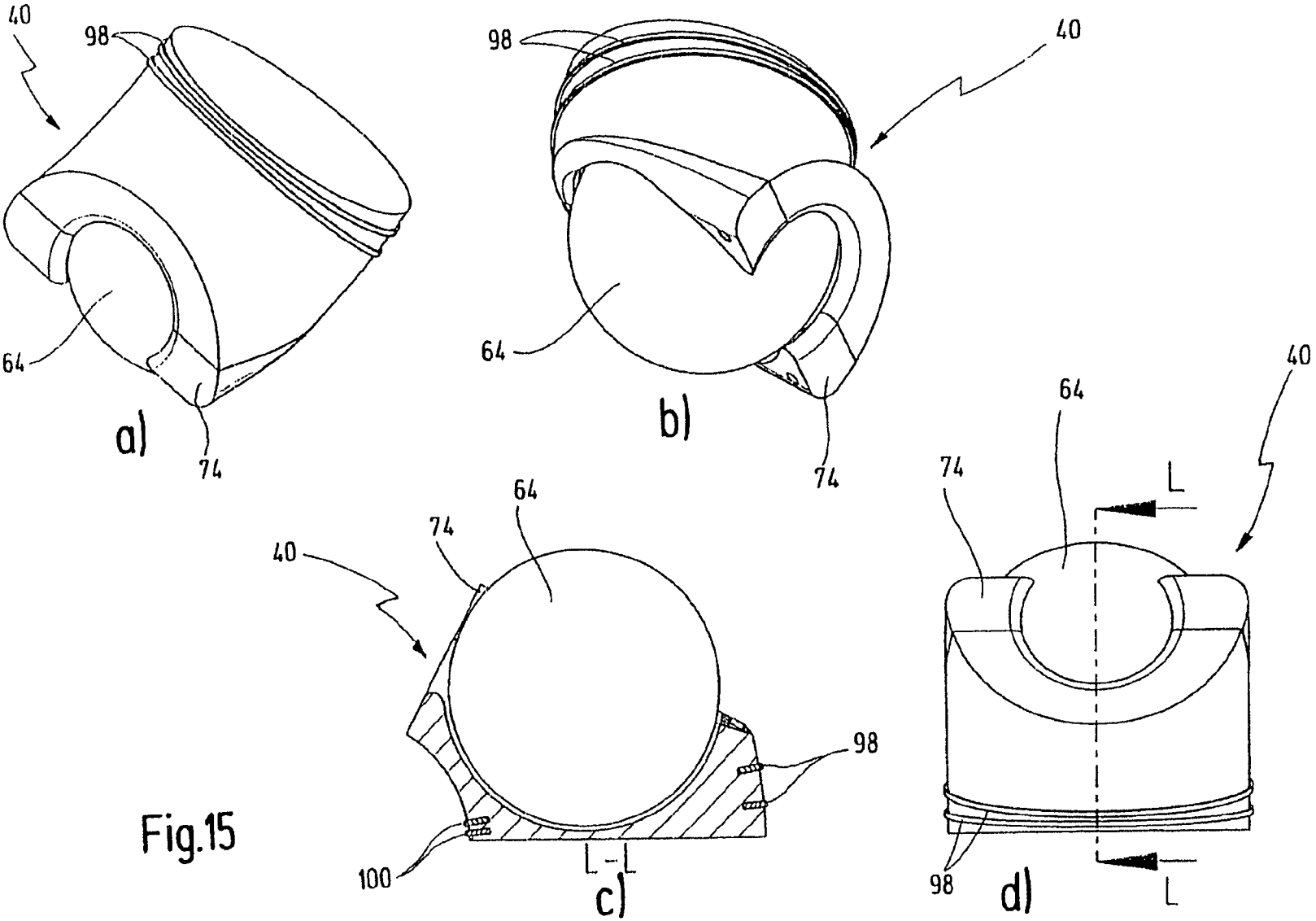
FIG. 15*a*) to *d*) show various perspective views and sections of a piston of the oscillating-piston machine including its running member in stand-alone form.

FIGS. 1 to 10 and FIGS. 11 and 12 show various illustrations of an oscillating-piston machine provided with the general reference numeral 10. Further details of the oscillating-piston machine 10 are illustrated in FIGS. 13 to 15.

In the present exemplary embodiment, the oscillating-piston machine 10 is designed as an internal combustion engine.

The oscillating-piston machine 10 has a housing 12 which is assembled from two housing halves 14 and 16. The housing halves 14 and 16 each have a flange 18*a* and 18*b*, by means of which the housing halves 14 and 16 are releasably connected to one another.

Figure 1:
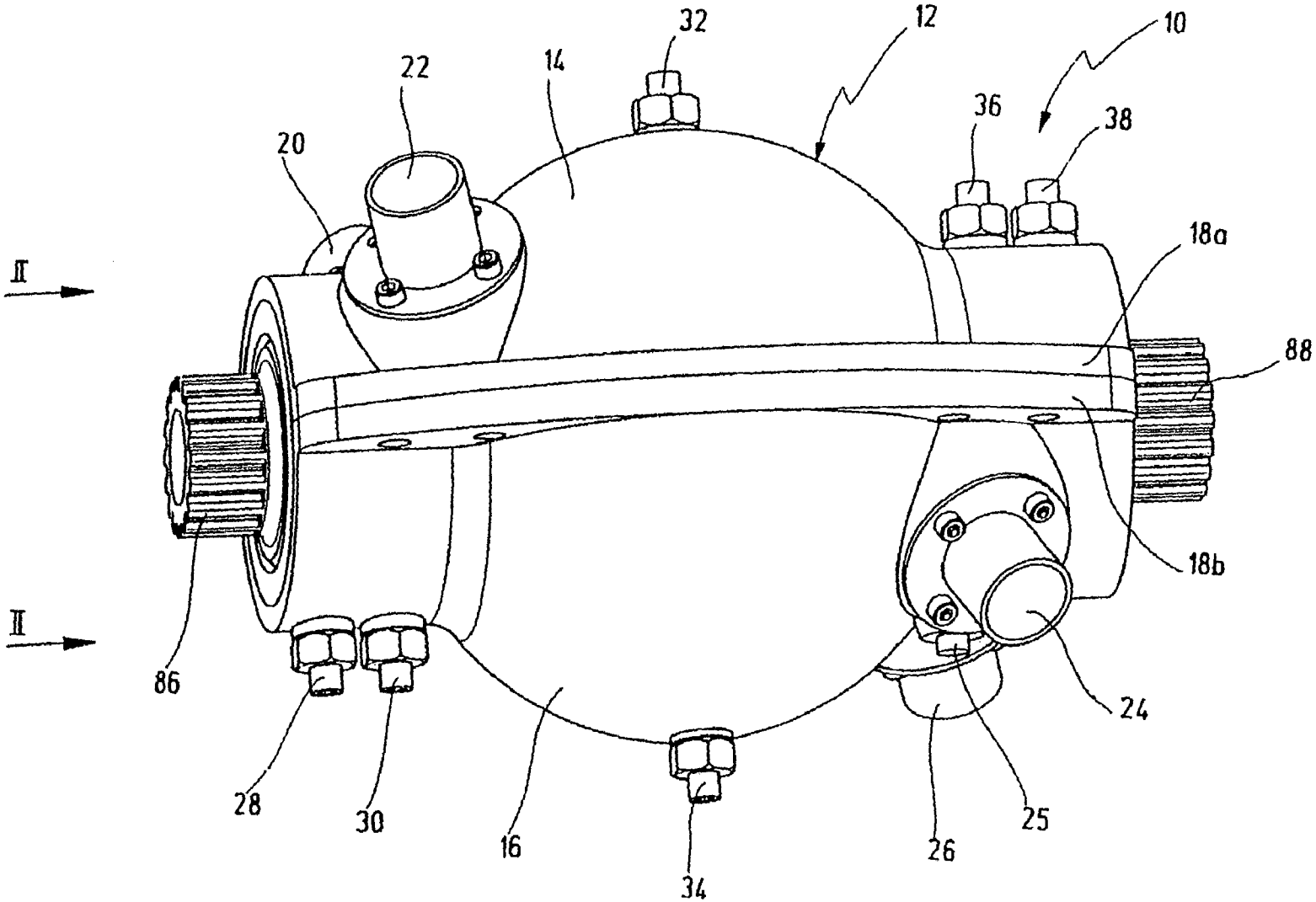
FIG. 1 shows a perspective overall view of an oscillating-piston machine.
Figure 2:
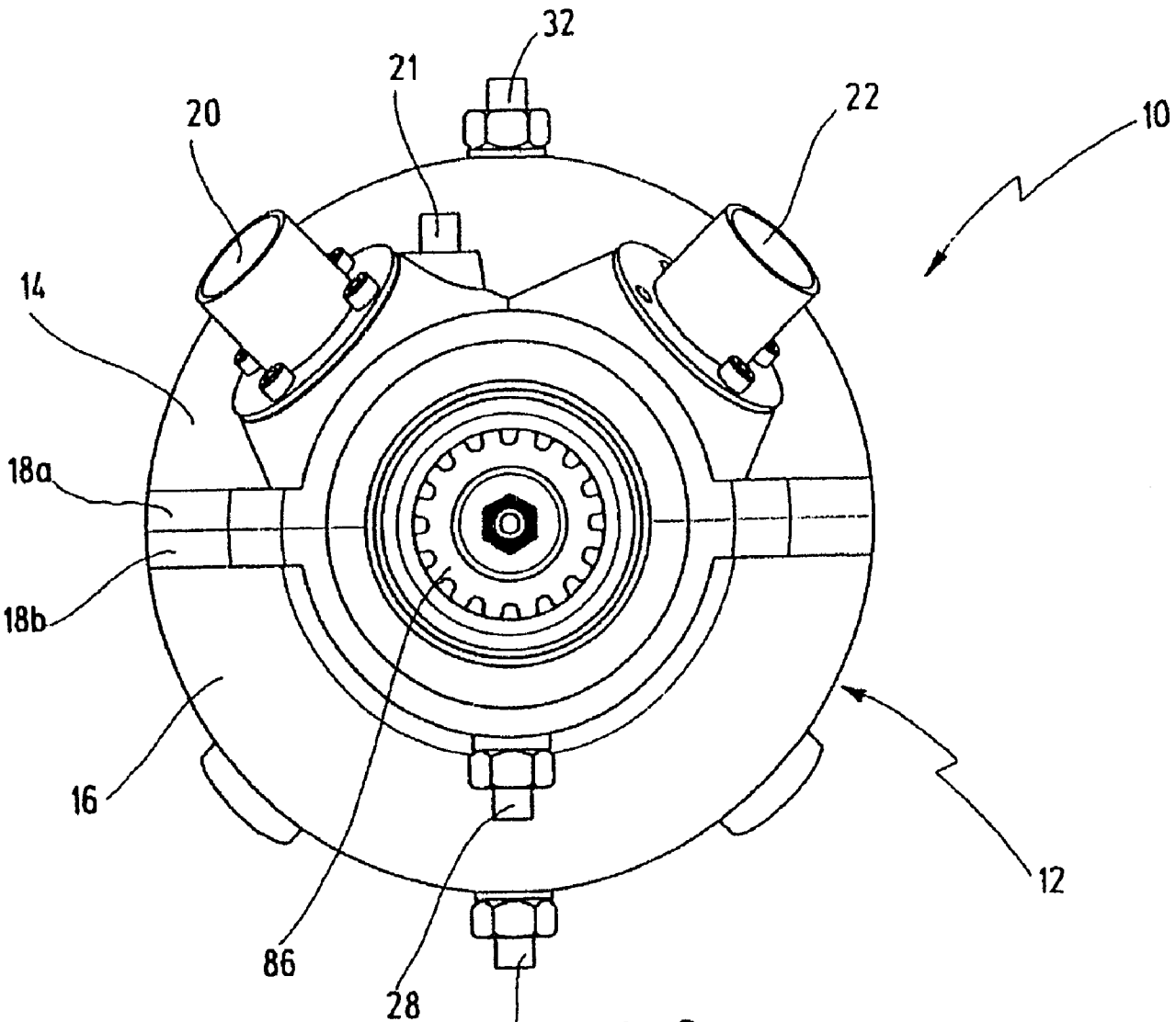
FIG. 2 shows a view of the oscillating-piston machine from FIG. 1 in the direction of arrows II in FIG. 1.

Inlet connection pieces 20 and 24 for fresh air/fuel, which are arranged diametrically opposite with respect to the centre of the housing and the openings of which pass through the housing (cf. FIG. 9), are arranged at the housing 12. Outlet connection pieces 22 and 26 are likewise provided. The inlet connection pieces 20 and 24 are used to supply fresh air or combustion air, while the outlet connection pieces 22 and 26 are used to discharge burnt fuel-air mix. The inlet connection pieces 20 and 24 are each assigned a connection for a fuel injection nozzle, as illustrated by a connection 25 for the connection piece 24 (cf. also FIG. 9). FIG. 2 illustrates a corresponding connection 21 for the inlet connection piece 20.

Furthermore, a plurality of connections 28 to 38 for supplying and discharging and/or circulating a cooling/lubricating medium through the interior of the oscillating-piston machine 10 are arranged at the housing.

Figure 3:
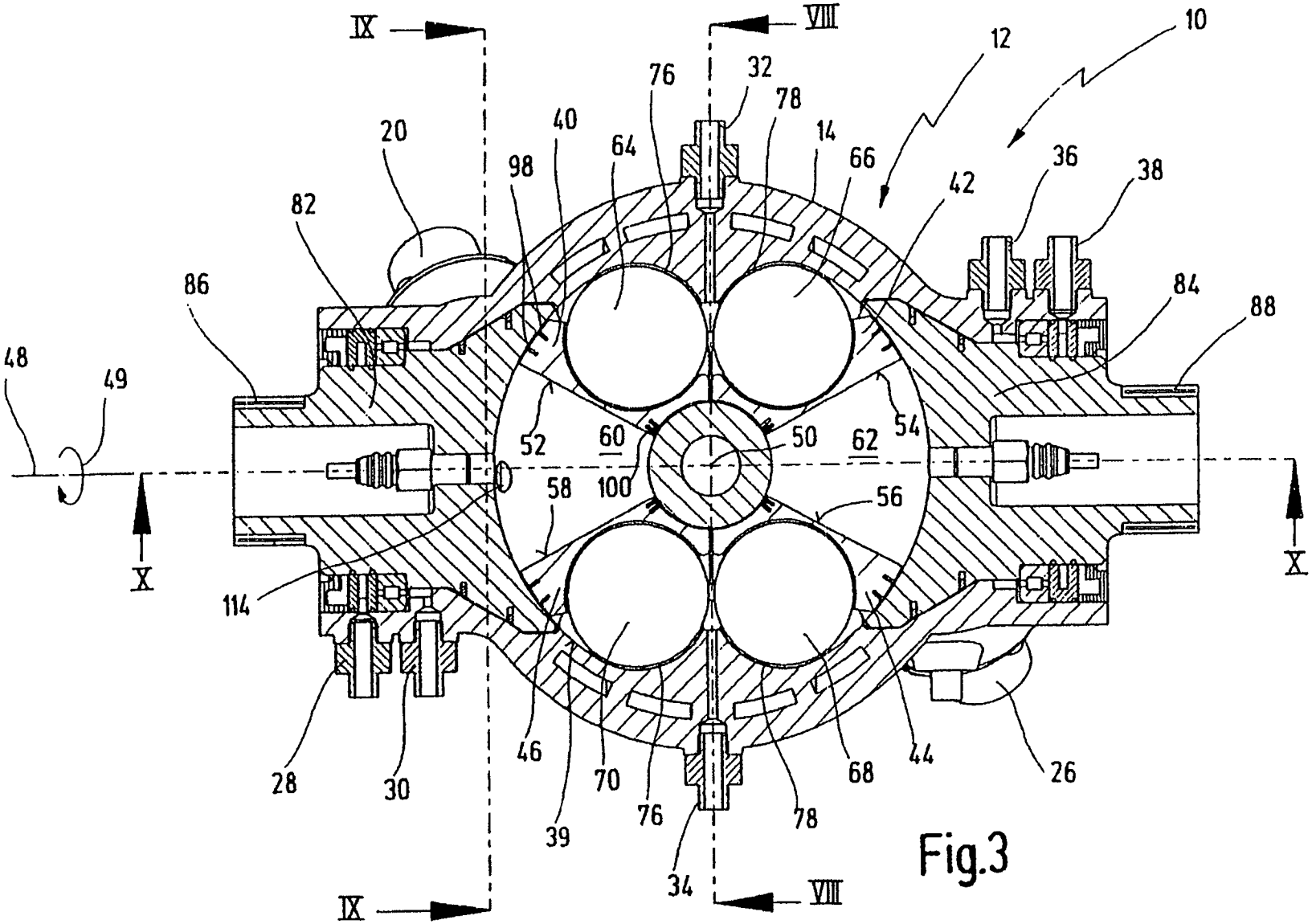
FIG. 3 shows a longitudinal section through the oscillating-piston machine on a plane parallel to the axis of rotation and perpendicular to the pivot axis, with the pistons of the oscillating-piston machine illustrated in a first operating position.

In the exemplary embodiment of the oscillating-piston machine 10, a housing inner wall 39 is substantially spherical in form or is spherical-symmetrical, as can be seen, for example, from FIG. 3.

Four pistons 40 to 46, which in the housing 12 can jointly revolve about an axis of rotation 48 as indicated by an arrow 49 (FIG. 3), are arranged in the interior of the housing 12. During this revolving movement, the pistons 40 to 46 execute an pivoting movement, which is superimposed on the revolving movement, about a pivot axis 50 between two limit positions, one limit position being illustrated in FIG. 3 (referred to as the BDC position), and the other limit position being illustrated in FIG. 6 (referred to as the TDC position).

Both the axis of rotation 48 and the pivot axis 50, which are to be understood as geometric axes, pass through the centre of the spherical housing 12. Furthermore, the pivot axis 50 is always perpendicular to the axis of rotation 48, but likewise revolves around the latter in accordance with the revolving movement of the pistons 40 to 46 likewise about the axis of rotation 48.

Of the pistons 40 to 46, in each case two pistons are positioned diametrically opposite one another with respect to the pivot axis 50, specifically in every pivot position of the pistons 40 to 46, and specifically pistons 40 and 44, on the one hand, and pistons 42 and 46, on the other hand, are arranged diametrically opposite one another. However, the pistons 40 to 46 are mounted individually in the housing 12, i.e. are not rigidly connected to one another in pairs.

Each of the pistons 40 to 46 has an end face, i.e. the piston 40 has an end face 52, the piston 42 has an end face 54, the piston 44 has an end face 56 and the piston 46 has an end face 58.

End faces which respectively face one another, i.e. in the present case the end faces 54 and 56 of the pistons 42 and 44 and the end faces 52 and 58 of the pistons 40 and 46, in each case delimit a working chamber 60 and 62 serving as combustion chambers. The axis of rotation 48 passes through both working chambers 60, 62, preferably centrally in each position of the pistons.

Since respectively adjacent ones of the pistons 40 to 46 execute pivoting movements in opposite directions to one another as they revolve about the axis of rotation 48, the working chambers 60 and 62 always increase and decrease in size in the same direction as one another.

Figure 5:
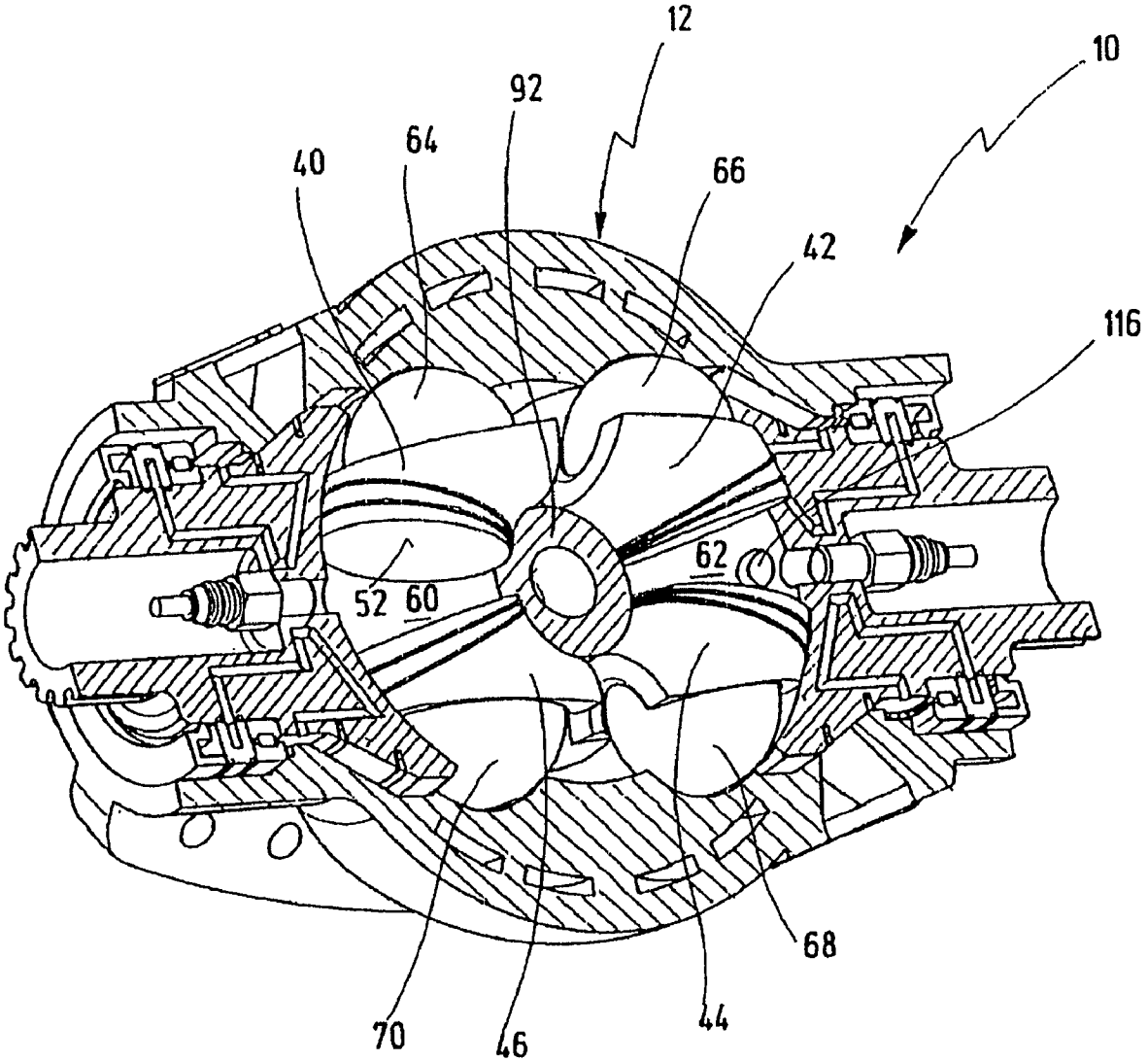
FIG. 5 shows an illustration of the oscillating-piston machine comparable to that shown in FIG. 4, with the pistons illustrated in a second operating position.
Figure 6:
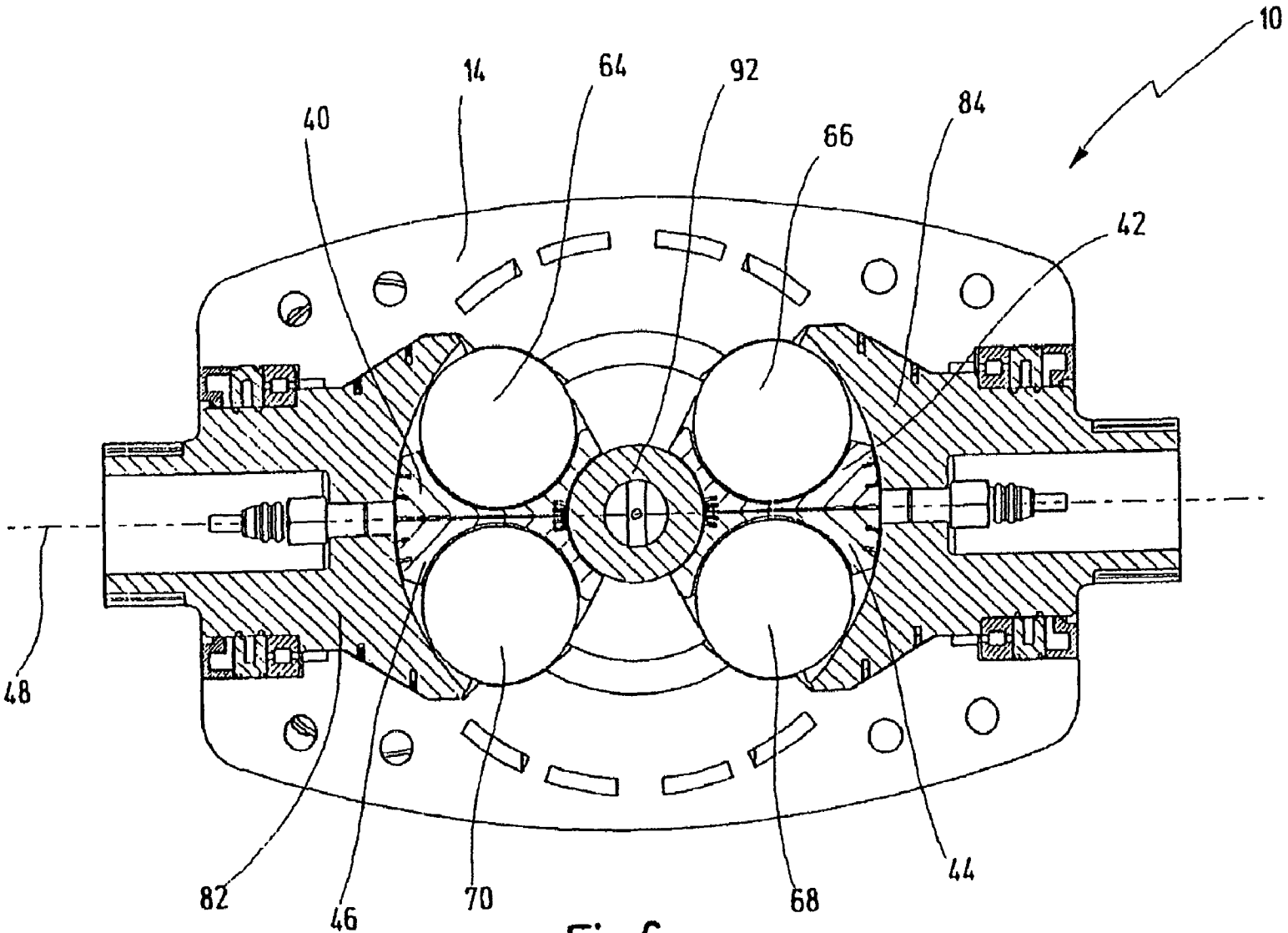
FIG. 6 shows a longitudinal section through the oscillating-piston machine from FIGS. 1 to 5, with the pistons illustrated in a third operating position.

By way of example, starting from the state in which the working chambers 60 and 62 have their maximum volume, as shown in FIG. 3, the pistons 40 and 46 pivote towards one another (FIG. 5), as do the pistons 42 and 44. In the process, the volumes of the working chambers 60 and 62 are reduced until the limit position illustrated in FIG. 6 is reached, in which the working chambers 60 and 62 adopt their minimum volume.

It will be understood that the pistons 40 and 46, as they pivote about the pivot axis 50, always remain to the left-hand side of line VIII-VIII in FIG. 3, and pistons 42 and 44 always remain to the right-hand side of the said line.

To derive the pivoting movements of the pistons 40 to 46 about the pivot axis 50 from the revolving movement of the pistons 40 to 46 about the axis of rotation 48, each piston 40 to 46 has a running member 64 (piston 40), 66 (piston 42), 68 (piston 44) and 70 (piston 46). The running members 64 to 70 are balls which are in each case mounted in a ball socket 72, as illustrated for piston 40 in FIG. 15, with the ball socket being arranged on an outer side of the respective piston 40 to 46, facing the housing inner wall 39.

As illustrated in FIG. 3, the balls 64 to 70 may be mounted loosely in the ball sockets 72 and held there by adhesion produced by a lubricating film, in which case the ball sockets 72 do not extend beyond the diameter of the balls 64 to 70, or alternatively the ball sockets may, as illustrated in FIG. 15*a*) and *b*), hold the balls 64 to 70 in a positively-locking manner and therefore captively by means of an extension 74 extending beyond the diameter of the balls.

In any case, the balls 64 to 70 can rotate freely in the ball socket 72 in all directions about their respective centres.

The running members or balls 64 to 70 are assigned two control cams in which the balls 64 to 70 run. More accurately, the balls 64 and 70 of the pistons 40 and 46 are assigned a first control cam 76, which is designed as a groove with a cross section in the form of part of a circle in the housing inner wall 39. A corresponding control cam 78 is assigned to the running members or balls 66 and 68 of the pistons 42 and 44.

The balls 64 and 70 therefore run in the same control cam 76, and the balls 66 and 68 run in the same control cam 78. The balls 64 and 70, on the one hand, and the balls 66 and 68, on the other hand, are in each case offset by 180° from one another with respect to the axis of rotation 48.

The control cams 76 and 78 are arranged at least approximately at the maximum distance from the axis of rotation 48, as can be seen from FIG. 3, i.e. they are located approximately at the level of the pivot axis 50. Overall, the control cams 76 and 78 run substantially orthogonally to the axis of rotation 48.

FIG. 14, which shows the housing half 14 alone, provides a perspective illustration of the control cams 76 and 78 in detail.

The pistons 40 to 46 are mounted in the housing 12, in a piston cage 80 which revolves about the axis of rotation 48 together with the pistons 40 to 46 and is described in more detail below together with further details of the pistons 40 to 46. FIGS. 11 to 13 illustrate the piston cage 80 in the form of views which are not taken in section.

In the exemplary embodiment shown and preferably, the piston cage 80 is a single-piece component, although a multi-piece design is also conceivable instead of a single-piece design.

The piston cage 80 extends along the axis of rotation 48 over the entire length of the housing 12, with shaft extensions 86 and 88 of the piston cage 80 projecting out of the housing.

The piston cage 80 in each case has a main bearing section 82 and 84 which adjoins the shaft extensions 86 and 88 and via which the piston cage 80 is mounted in the housing 12 such that it can rotate about the axis of rotation 48. The bearing sections 82 and 84 are connected in the centre of the housing by way of a centre section 90, which has a pin-like section 92 which extends along the pivot axis 50 and on which the pistons 40 and 46 are mounted with respect to the centre of the housing or the pivot axis 50.

Figure 10:
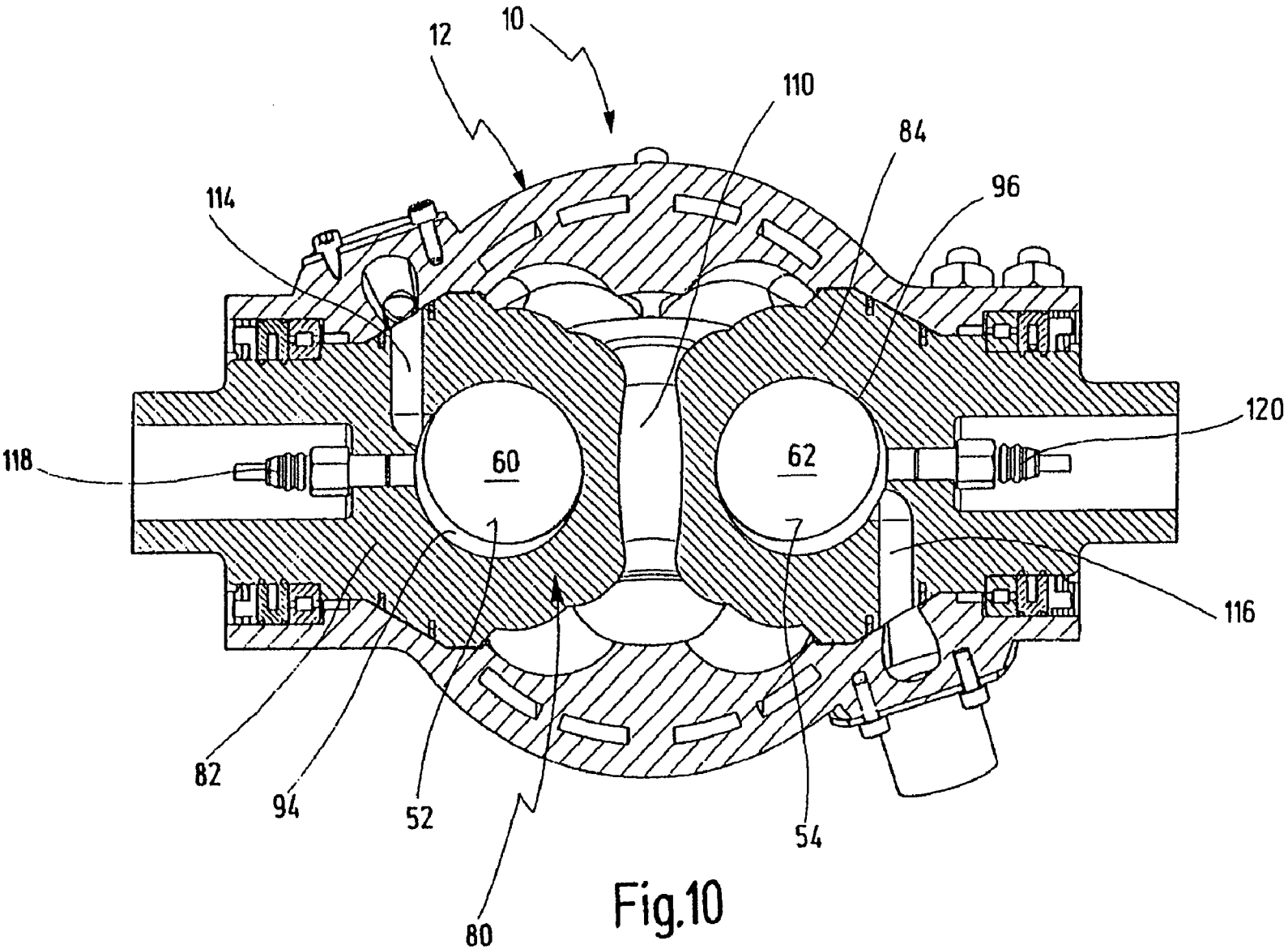
FIG. 10 shows a longitudinal section on line X-X from FIG. 3 through the oscillating-piston machine as shown in FIGS. 1 to 9.

In accordance with FIG. 10, the piston cage 80 has two bores 94 and 96, in which the pistons 40 to 46 are slideably mounted. More accurately, the pistons 40 and 46 are mounted slideably in bore 94, and the pistons 42 and 44 are mounted slideably in bore 96. The bores 94 and 96 are circular in form, and accordingly the end faces 52 to 58 of the pistons 40 to 46 are likewise of circular design. The pistons 40 to 46 are mounted in the bores 94 and 96 by means of piston rings for sealing the working chambers 60 and 62, as illustrated by seals 98 (outside) and 100 (inside) for piston 40 in FIG. 3. In accordance with FIG. 3, pistons 42 to 46 have corresponding seals on their radially outer side and their radially inner side.

The bores 94 and 96, together with the end faces 52 to 58, delimit the working chambers 60 and 62.

In the bores 94 and 96 in the piston cage 80, the pistons 40 to 46 are rotationally fixedly connected to the piston cage 80, so that the pistons 40 to 46, together with the piston cage 80, revolve about the axis of rotation 48, while the pistons 40 to 46 can move slideably within the bores 94 and 96, in accordance with their pivoting movements about the pivot axis 50, in order to carry out the individual working strokes of intake, compression, expansion and exhaust.

The pistons 40 to 46 are designed substantially in the form of arcs, as illustrated in FIG. 15, and the working chambers 60 and 62 are also approximately in the form of a curved or arcuate cylinder, with the curvature being concentric with respect to the pivot axis 50.

The arrangement made up of piston cage 80, pistons 40 to 46 as well as the running members 64 to 70 forms the "inner motor" of the oscillating-piston machine 10, i.e. this arrangement comprises all the moving parts of the oscillating-piston machine 10.

Figure 4:
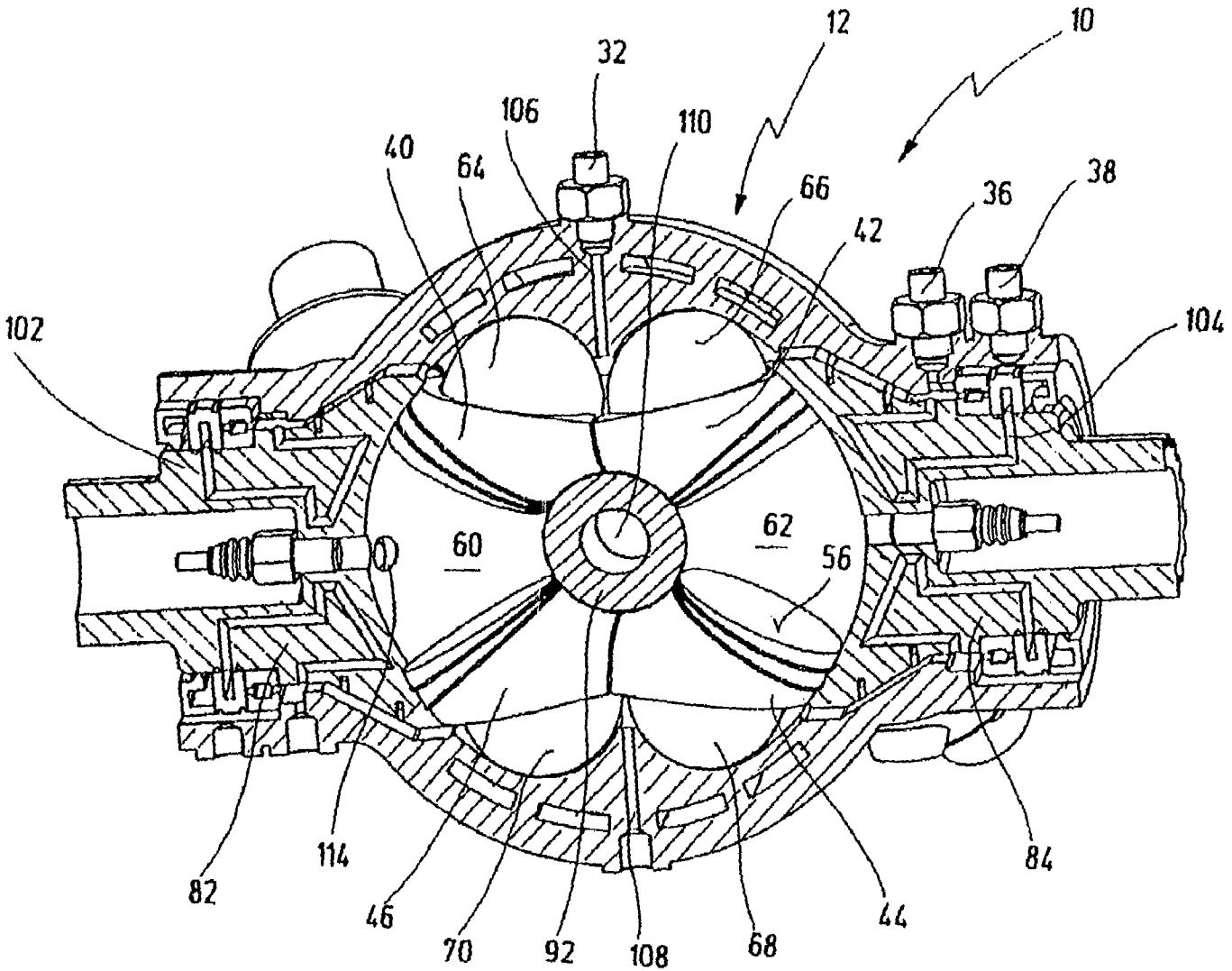
FIG. 4 illustrates the oscillating-piston machine in the same operating position of the pistons as in FIG. 3, in the form of a slightly perspective view, without the pistons being shown in section.
Figure 9:
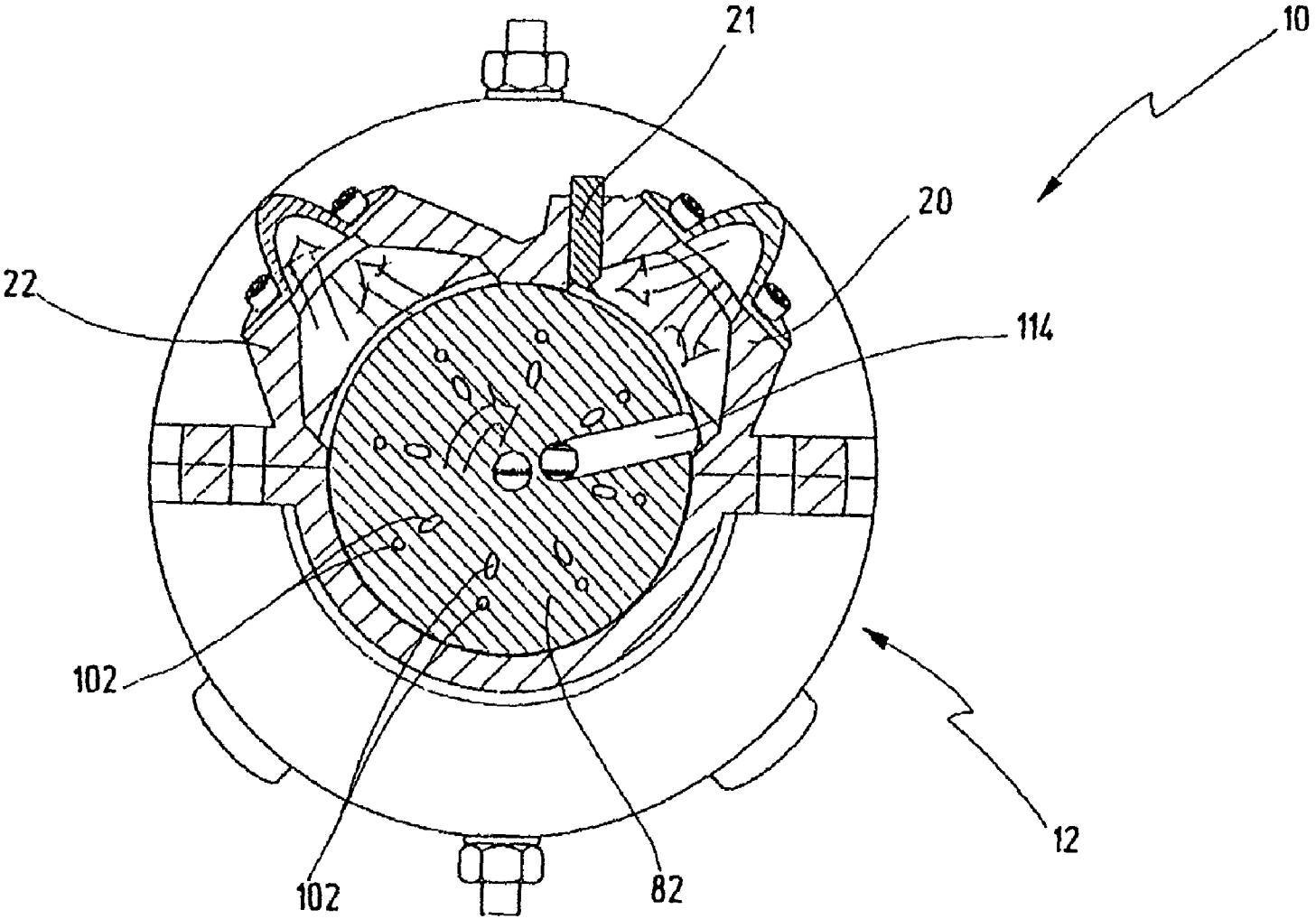
FIG. 9 shows a section through the oscillating-piston machine on line IX-IX from FIG. 3.

As illustrated by way of example in FIGS. 4 and 9, a plurality of passages 102 and 104 are present in the bearing sections 82 and 84, respectively, of the piston cage 80, which passages extend circumferentially and through the interior of the bearing sections 82 and 84 of the piston cage 80 and are in communication with the connections 28, 30 and 36, 38 which have already been mentioned above, so that a cooling/lubricating medium for cooling and lubricating the piston cage 80 can be passed through the passages 102, 104. The passages 102 and 104 serve primarily to cool the inner motor in the vicinity of the working chambers 60, 62.

In accordance with FIG. 4, cooling/lubricating medium passages 106 and 108 are likewise formed in the housing 12, with a bore 110, which likewise serves as a cooling/lubricating medium passage, passing through the centre section 90 of the piston cage 80 in the direction of the pivot axis 50. When the piston cage 80 rotates about the axis of rotation 48, the cooling/lubricating medium which is present in the bore 110 is thrown towards the housing inner wall 39 as a result of centrifugal forces. In this way, the pistons 40 to 46 and the running members 64 to 70 in the centre of the inner motor are cooled and/or lubricated. At the running members 64 to 70, the lubricating film which forms also serves to hold the running members 64 to 70 in the ball sockets 72 of the pistons 40 to 46 through adhesion, unless, as illustrated in FIG. 15, this is achieved by a positively locking action.

The bore 110 widens out in the shape of a trumpet at both its ends, in order to improve the distribution of the cooling/lubricating medium in the centre of the housing 12 still further.

In accordance with FIGS. 9 and 10, two further bores or passages 114 and 116 are also provided in the piston cage 80; these bores or passages on one side open out in the bores 94 and 96, respectively, and on the other side open out towards the housing inner wall 39, specifically at the level of the inlet or outlet connection pieces 20 and 22 or 24 and 26, respectively. The passages 114 and 116 are used to admit a fuel-air mix to the working chambers 60, 62 through the inlet connection pieces 20 and 24, respectively, in one rotational position of the piston cage 80 about the axis of rotation 48, and to discharge burnt fuel-air mix through the outlet connection pieces 22 and 26 in a different rotary position. In the other rotary positions, the piston cage 80 closes off these connection pieces. The piston cage 80 therefore simultaneously performs the function of a valve for opening and closing the connection pieces 20 to 26.

As can also be seen from FIG. 10, a spark plug 118 and 120 for each working chamber 60 and 62 is provided in the piston cage 80, these spark plugs being arranged on the axis of rotation 48 and rotating about the latter together with the piston cage 80. Electrical supply conductors (not shown) are correspondingly connected to the spark plugs 118 and 120 via slip rings, for example. If the oscillating-piston machine 10 is used as a diesel engine, the plugs 118 and 120 are correspondingly glow plugs.

The arrangement of the connection pieces 20 and 22 offset through 180° about the axis of rotation 48 with respect to the connection pieces 24 and 26 serves to ensure that an expansion operation always takes place in at least one of the working chambers 60 and 62 as the pistons 40 and 46 revolve through 360° about the axis of rotation 48. Therefore, precisely when an expansion stroke is taking place in the working chamber 60, an exhaust stroke for discharging burnt fuel-air mix is taking place in the working chamber 62, and vice versa.

The way in which the oscillating-piston machine 10 functions is described below.

Starting from the operating position of the pistons 40 to 46 shown in FIGS. 3 and 4, the pistons 40 and 46 in that position are in what is known as their BDC (bottom dead centre) position. After rotation through 45° about the axis of rotation 48, the pistons 40 and 46 or 42 and 44 have moved halfway towards one another, as illustrated in FIG. 5. The volume of the working chambers 60 and 62 has there been reduced by approximately half. The pivoting movement of the pistons 40 to 46 was in this case imparted by the running members 64 to 70 being guided in the control cams 76 and 78.

Figure 7:
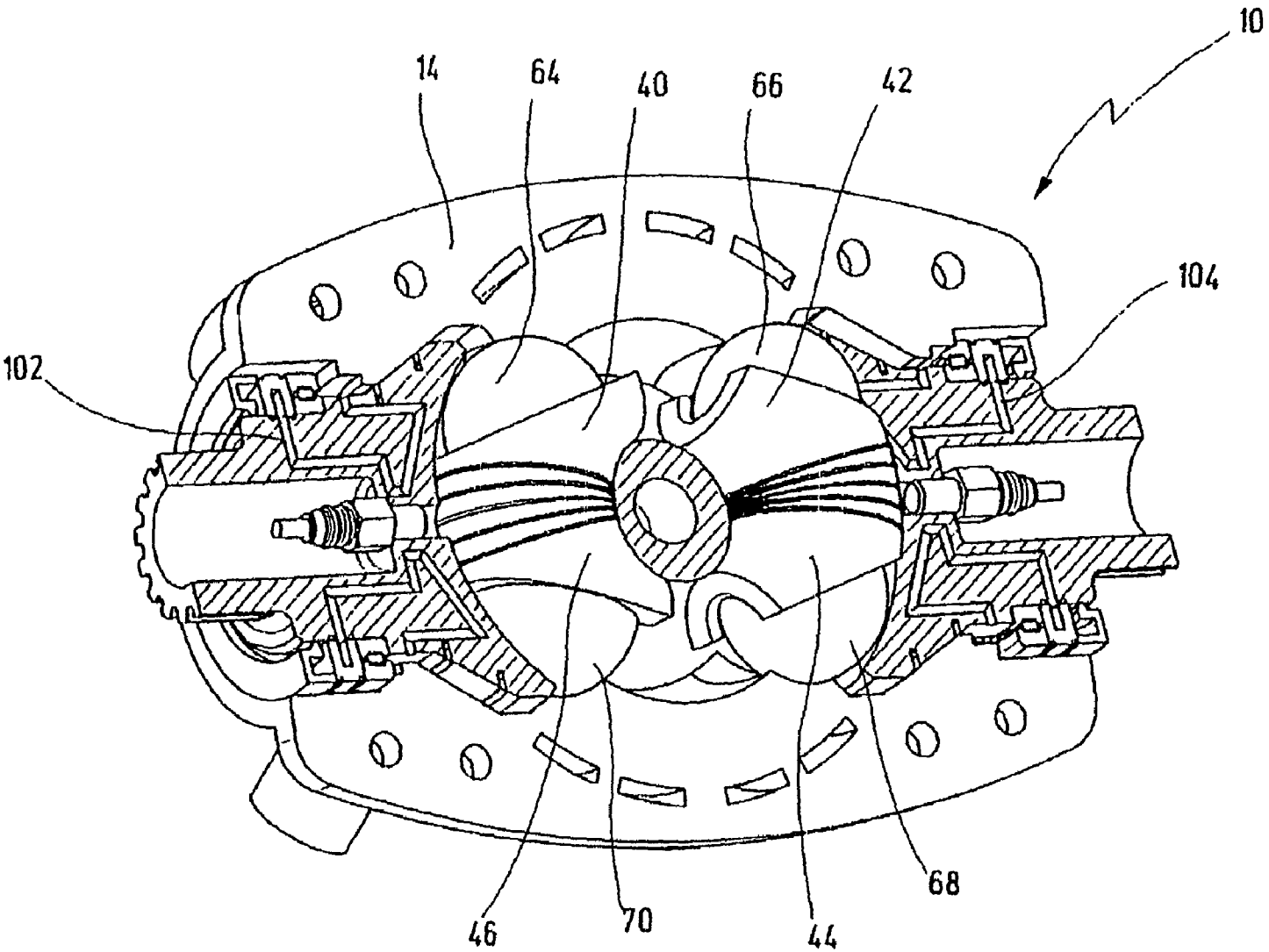
FIG. 7 illustrates the oscillating-piston machine with the pistons in the same operating position as in FIG. 6, in the form of a slightly perspective view without the pistons being illustrated in section.
Figure 8:
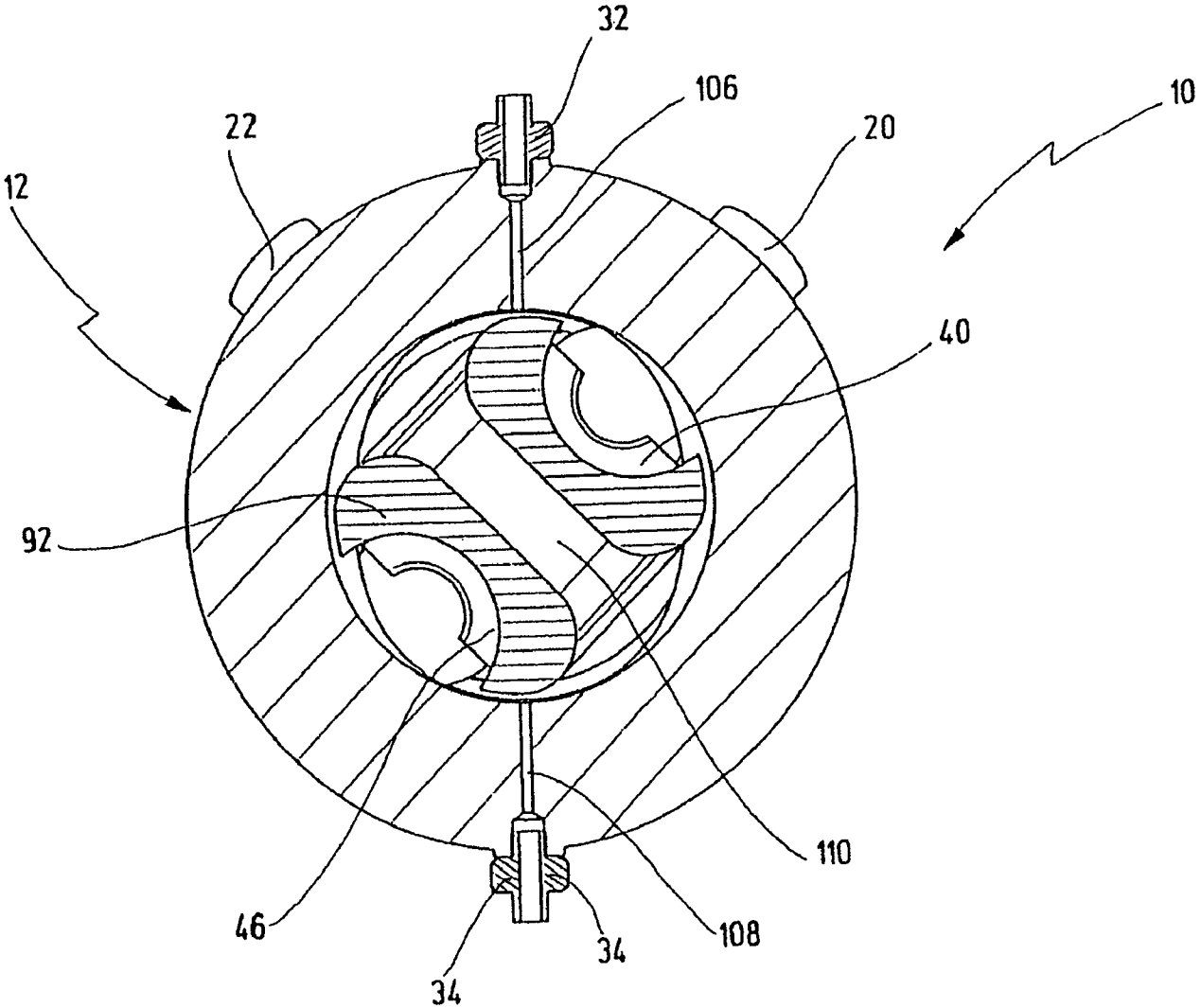
FIG. 8 shows a section through the oscillating-piston machine on line VIII-VIII from FIG. 3.

After further rotation through 45° about the axis of rotation 48, the pistons 40 to 46 then adopt the TDC (top dead centre) position illustrated in FIGS. 6 and 7, in which the volumes of the working chambers 60 and 62 are at a minimum. After further rotation through 45° about the axis of rotation 48, progressing in the same direction, the pistons 40 to 46 then return to the position shown in FIG. 5, and after further rotation through 45° they once again adopt the position shown in FIG. 3. The working chambers 60 and 62 are once again at a maximum after rotation through 180° about the axis of rotation 48.

Therefore, after a full revolution through 360°, the four strokes of intake, compression, expansion and exhaust have taken place once in each of the working chambers 60 and 62.

Figure 10A:
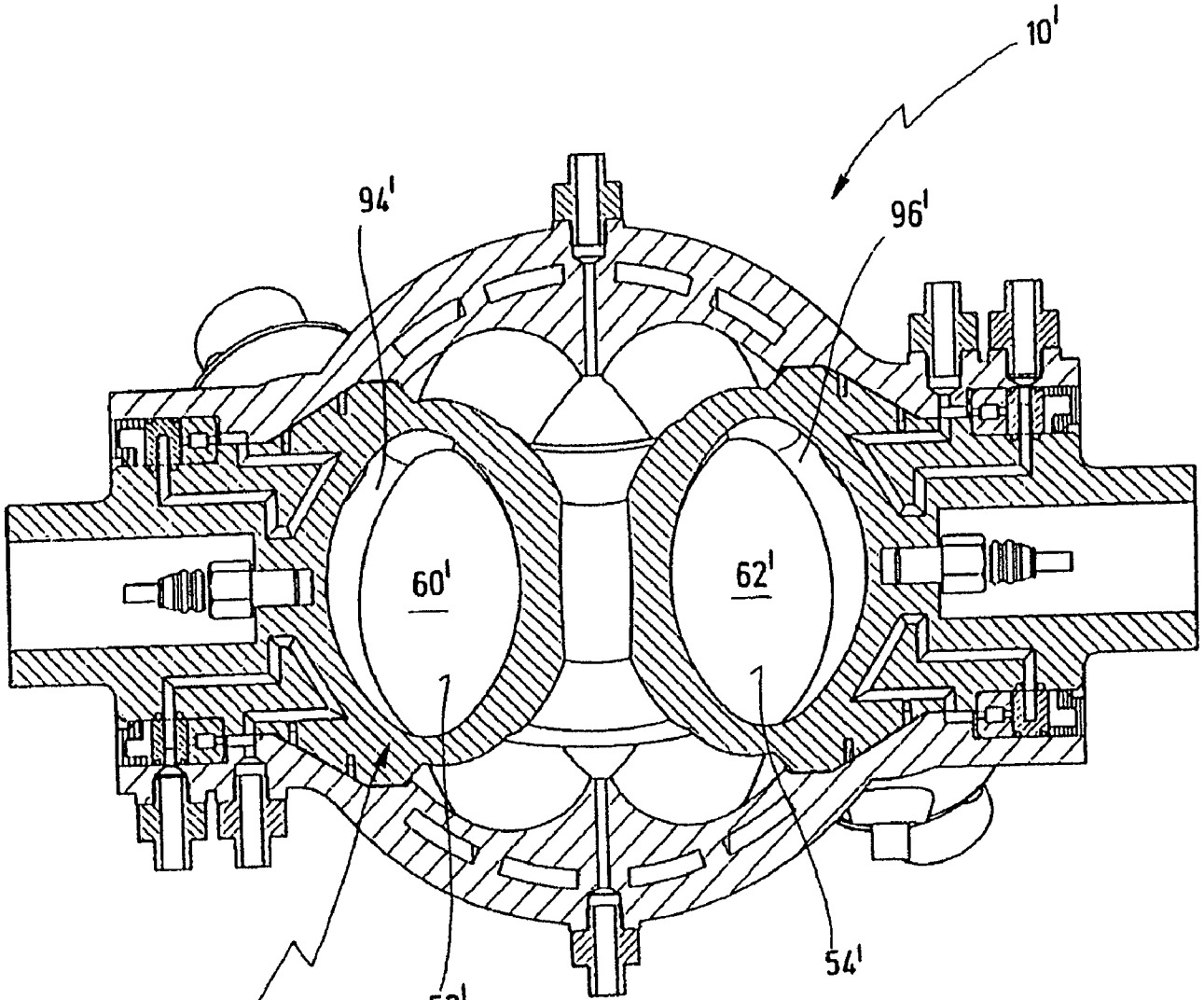
FIG. 10A shows an illustration comparable to FIG. 10 of a modified exemplary embodiment of the oscillating-piston machine.

FIG. 10A illustrates a slightly modified configuration of an oscillating-piston machine 10', which differs from the oscillating-piston machine 10 only by virtue of the fact that the bores 94' and 96' in the piston cage 80', and accordingly the end faces 52' and 54' (and the same is also true of the end faces 56' and 58', which are not illustrated) are not circular, but rather, as illustrated by way of example in FIG. 10A, are oval or elliptical in form. This allows the size of the working chambers 60' and 62' to be increased compared to the circular configuration.

Figure 16:
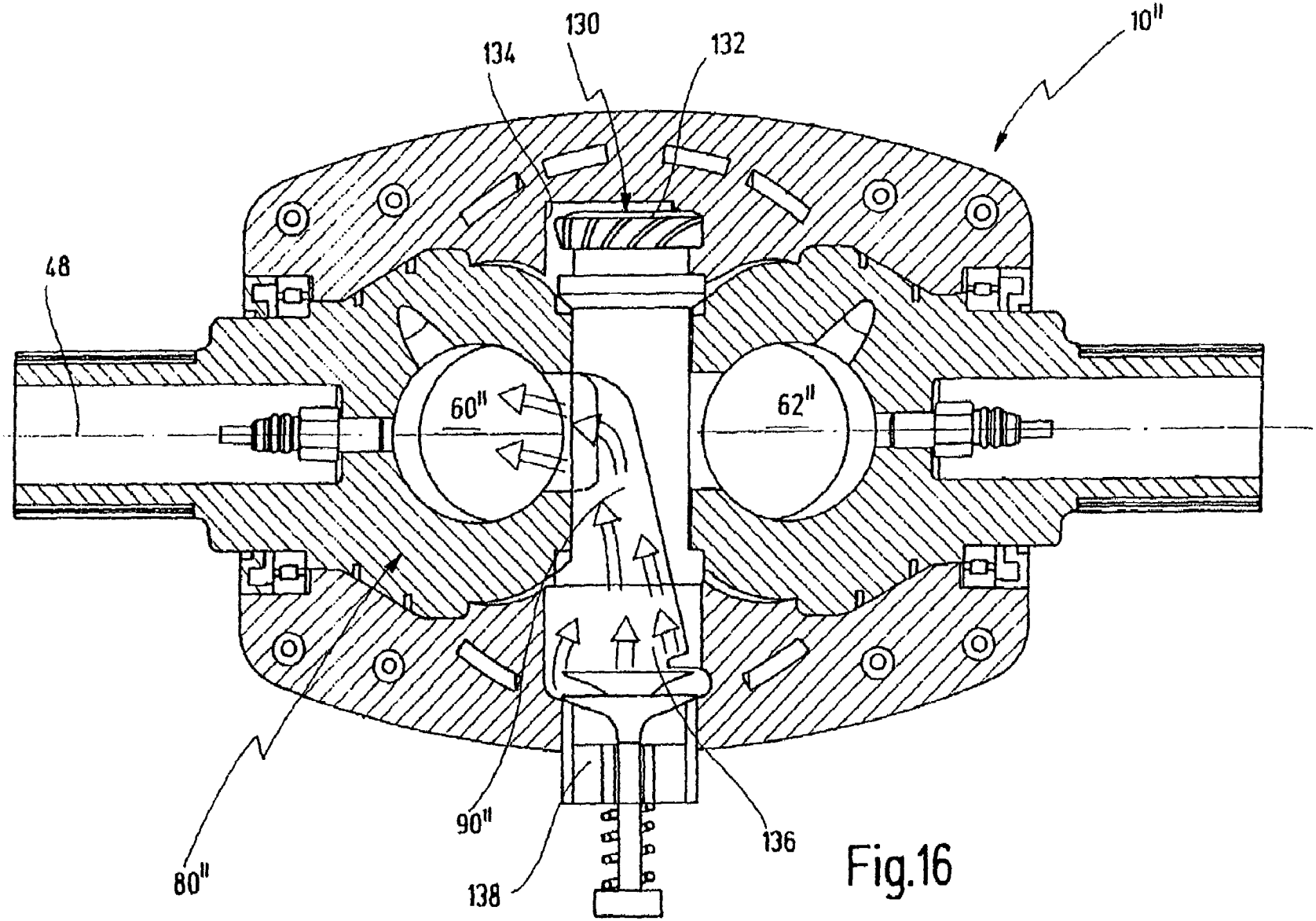
FIG. 16 shows a longitudinal section through an oscillating-piston machine in accordance with a further exemplary embodiment.
Figure 17:
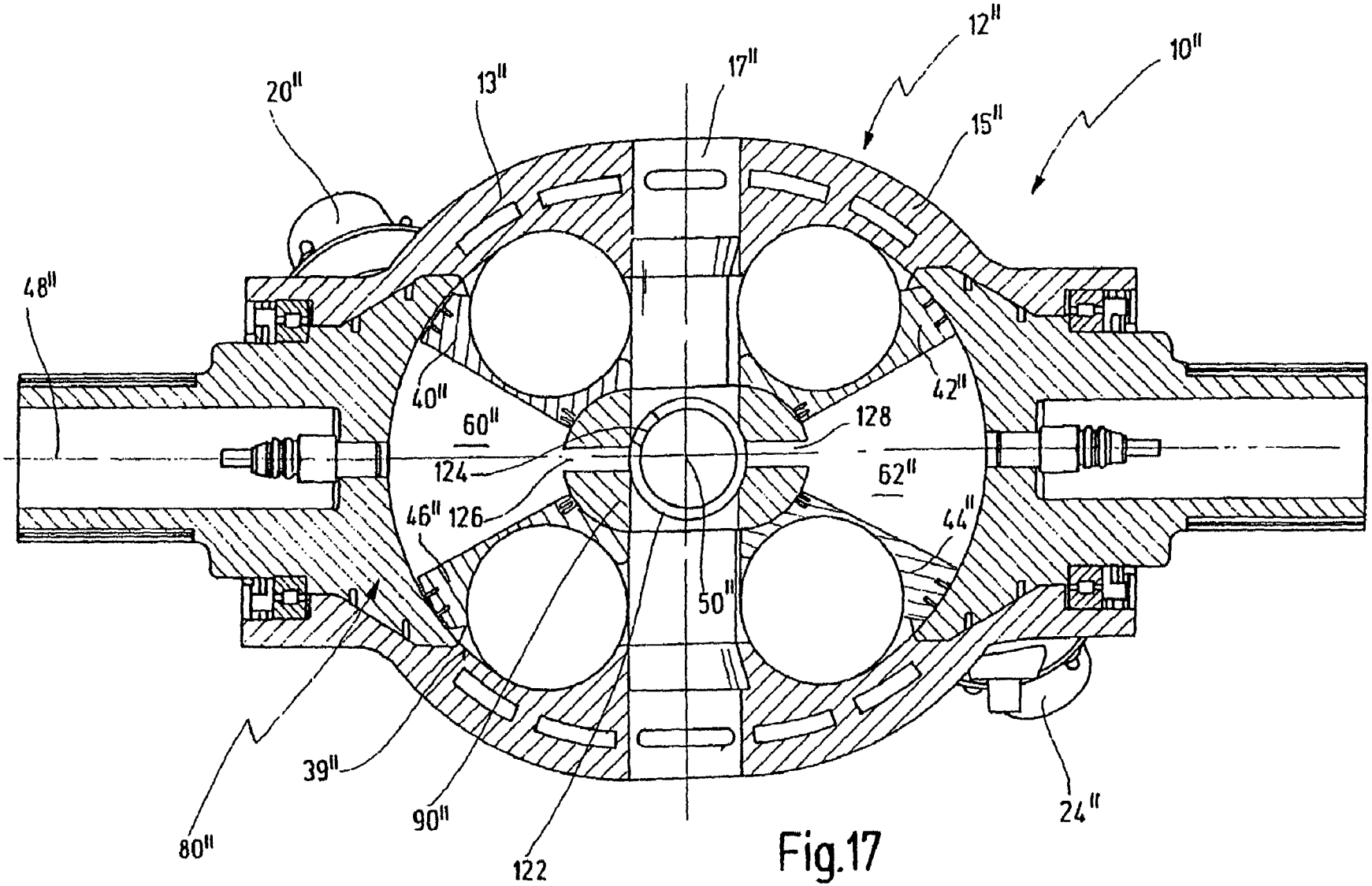
FIG. 17 shows a longitudinal section through the oscillating-piston machine from FIG. 16 in section along a plane which is rotated through 90° with respect to the section plane in FIG. 16.

FIGS. 16 and 17 illustrate yet another exemplary embodiment of an oscillating-piston machine 10", which differs from the oscillating-piston machine 10 or oscillating-piston machine 10' as follows.

Whereas the housing 12 of the oscillating-piston machine 10 and of the oscillating-piston machine 10' is spherical-symmetrical, the housing 12" of the oscillating-piston machine 10" is of oblong design. More specifically, the housing 12" comprises two hemispheres 13" and 15", between which there is inserted an elongate section 17" extending in the direction of the axis of rotation 48". This makes the housing 12" longer in the direction of the axis of rotation 48" compared to the design of the housing 12, which allows the following measures.

A hollow pin 122, which has an opening 124 in its wall, is arranged on the inner side of the central section 90" of the piston cage 80", which in accordance with FIG. 17 is likewise designed to be oblong in cross section. The central section 90" has two openings 126 and 128 on the axis of rotation 48", with which the opening 124 in the hollow pin 122 is in communication depending on its rotational position, although the opening 124 can in each case only be in communication with one of the openings 126 and 128 at a time. The hollow pin 124 is mounted in the central section 90" such that it can rotate about the pivot axis 50". The rotational movement of the hollow pin 122 about the pivot axis 50" is derived from the revolving movement of the piston cage 80" about the axis of rotation 48". For this purpose, at one end the central section 90" has a transmission mechanism 130, which includes worm toothing 123 fixedly connected to the hollow pin 122. The worm toothing or worm gear 132 meshes with toothing 134 arranged concentrically around the axis of rotation 48, so that when the central section 90" including the hollow pin 122 revolves about the axis of rotation 48 the worm toothing 132 and therefore the hollow pin 122 are made to rotate about the pivot axis 50".

Furthermore, an inlet 136 for fresh air, which can be opened and closed by, for example, a standard valve device 138, is provided in the housing. Fresh air, in particular precompressed fresh air, can now be introduced into the interior of the hollow pin 122 through the inlet 136, and then, depending on the rotational position of the hollow pin 122 relative to the openings 126, 128, the fresh air is introduced into the working chambers 60" or 62", specifically in addition to the supply of fuel-air mix through the connection pieces 20" and 24". This makes the oscillating-piston machine 10" what is known as a supercharged engine.

The worm toothing 132 and the toothing 134 are accordingly to be designed in such a way that the rotational movement of the hollow pin 122 about the pivot axis 50" is suitably synchronized with the piston positions of the pistons 40" to 46". This means that the supply of fresh air through the hollow pin 122 into the working chamber 60" or into the working chamber 62" should preferably take place when, or the opening 124 should be in communication with the respective opening 126 and 128 when, the ignition of the fuel-air mix admitted through the inlet connection pieces 20" and 24" is just on the verge of igniting. Rotation of the hollow pin through 360° about the axis of rotation 48" should cause it to rotate through 360° about the pivot axis 50.

Otherwise, the oscillating-piston machine 10" corresponds to the configurations of the oscillating-piston machine 10 or 10', and consequently in this respect reference can be made to the description given of those oscillating-piston machines.

What is claimed is:

1. An oscillating-piston machine, comprising:

a housing defining a centre, a first piston and at least a second piston, said first piston and said at least second piston being arranged in said housing and being able to revolve together in said housing about an axis of rotation which is stationary with respect to said housing, said first piston and said at least second piston executing oppositely directed reciprocating pivoting movements about a pivot axis, as said first and said at least second piston revolve about said axis of rotation, said pivot axis running perpendicular through said axis of rotation and through said centre of said housing, said first piston having a first end face, and said at least second piston having a second end face facing said first end face, said first end face and said second end face delimiting a first working chamber, and said first piston and said at least second piston being arranged in such a way that said axis of rotation runs through said first working chamber.

2. The oscillating-piston machine of claim 1, wherein said first end face and said second end face are circular in form.

3. The oscillating-piston machine of claim 1, wherein said first piston and said at least second piston are designed substantially in the form of an arc.

4. The oscillating-piston machine of claim 1, wherein at least one of said first piston and said at least second piston has at least one running member which, when said at least one of said first and said at least second piston is revolving, is guided along a corresponding designed control cam, in order to generate said pivoting movements of said first piston and said at least second piston, said control cam being arranged on said housing, at least approximately a maximum distance from said axis of rotation.

5. The oscillating-piston machine of claim 4, wherein said at least one running member is a ball which is mounted rotatably in a ball socket on an outer side, facing said housing, of said at least one of said first and said at least second piston, and wherein said control cam is designed as a groove with a cross section in the form of part of a circle in said housing, said ball partially engaging said groove.

6. The oscillating-piston machine of claim 1, wherein said first piston and said at least second piston are mounted slideably in a piston cage, which is arranged in said housing, concentrically with respect to and rotatable about said axis of rotation, said piston cage being rotationally fixedly connected to said first and said at least second piston with respect to said revolving movement about said axis of rotation.

7. The oscillating-piston machine of claim 6, wherein said piston cage, approximately perpendicular to said axis of rotation, has a bore in which said first piston and said at least second piston are partially received, such that they slide therein, and which delimits said first working chamber in circumferential direction of said first working chamber.

8. The oscillating-piston machine of claim 7, wherein a first passage passes through said piston cage and on one side opens out in said bore, while on the other side it opens out towards said housing, in order to be in communication with at least one of an inlet opening and an outlet opening in said housing, depending on a rotational position of said piston cage.

9. The oscillating-piston machine of claim 6, wherein said piston cage has at least one second passage for a medium, which extends at least partially over a circumference and through an interior of said piston cage.

10. The oscillating-piston machine of claim 6, wherein a second bore passes through said piston cage at said pivot axis and oriented in direction of said pivot axis.

11. The oscillating-piston machine of claim 1, wherein a third and a fourth piston are arranged in said housing, said third and fourth pistons being arranged diametrically with respect to said first piston and said at least second piston, based on said pivot axis, said third piston and said fourth piston being able to pivote about said pivot axis and being able to revolve about said axis of rotation together with said first piston and said at least second piston and defining a second working chamber.

12. The oscillating-piston machine of claim 11, wherein said first, second, third and fourth pistons are arranged in such a way that said first and second working chambers, as said first, second, third and fourth pistons revolve about said axis of rotation, increase and decrease in size in the same sense.

13. The oscillating-piston machine of claim 6, wherein a third and a fourth piston are arranged in said housing, said third and fourth pistons being arranged diametrically with respect to said first piston and said at least second piston, based on said pivot axis, said third piston and said fourth piston being able to pivote about said pivot axis and being able to revolve about said axis of rotation together with said first piston and said at least second piston and define a second working chamber, and wherein said piston cage extends on both sides of said pivot axis and accommodates said first, second, third and fourth pistons.

14. The oscillating-piston machine of claim 1, wherein said housing has a housing inner wall which is substantially spherical in form.

15. The oscillating-piston machine of claim 1, wherein said housing has a housing inner wall which is oblong in direction of said axis of rotation, when seen in section along a plane which includes said axis of rotation and said pivot axis.

16. The oscillating-piston machine of claim 15, wherein a hollow pin, which can rotate about said pivot axis, is arranged in said housing, and in a wall of said hollow pin there is an opening which is in communication with said first working chamber as a function of a rotary position of said hollow pin.

17. The oscillating-piston machine of claim 16, wherein said hollow pin is connected to a transmission mechanism which, when said first and at least second piston revolve about said axis of rotation, makes said hollow pin rotate about said pivot axis.

18. The oscillating-piston machine of claim 17, wherein said transmission mechanism includes at least one of a worm toothing and a worm gear, which is connected to said hollow pin and meshes with at least one set of toothing which is arranged at said housing and extends around said axis of rotation.

* * * * *